US006676416B1

(12) United States Patent
Ellis et al.

(10) Patent No.: US 6,676,416 B1
(45) Date of Patent: Jan. 13, 2004

(54) RIBBON CABLE AND ELECTRICAL CONNECTOR FOR USE WITH MICROCOMPONENTS

(75) Inventors: Matthew D. Ellis, Allen, TX (US); George D. Skidmore, Plano, TX (US)

(73) Assignee: Zyvex Corporation, Plano, TX (US)

( * ) Notice: Subject to any disclaimer, the term of this patent is extended or adjusted under 35 U.S.C. 154(b) by 0 days.

(21) Appl. No.: 09/569,328

(22) Filed: May 11, 2000

(51) Int. Cl.[7] ..... H01R 12/00

(52) U.S. Cl. ..... 439/65; 439/953; 439/329; 439/353; 361/803

(58) Field of Search ..... 439/65, 67, 68, 439/928, 953, 329, 353; 257/685, 686, 777; 361/728, 729, 735, 732, 760, 773, 783, 784, 803

(56) References Cited

U.S. PATENT DOCUMENTS

| | | | | |
|---|---|---|---|---|
| 2,494,428 A | * | 1/1950 | Buck | |
| 3,268,774 A | * | 8/1966 | Ortner | |
| 3,439,416 A | | 4/1969 | Yando | 29/625 |
| 3,467,942 A | * | 9/1969 | Dell et al. | |
| 3,526,867 A | * | 9/1970 | Keeler, II | |
| 4,141,138 A | | 2/1979 | Quick | |
| 4,740,410 A | | 4/1988 | Muller | 428/133 |
| 4,955,814 A | * | 9/1990 | Christie et al. | 439/77 |
| 4,969,827 A | * | 11/1990 | Hahs, Jr. | 439/68 |
| 5,113,117 A | * | 5/1992 | Brooks et al. | 257/785 |
| 5,181,854 A | * | 1/1993 | Masuda | 439/67 |
| RE34,794 E | * | 11/1994 | Farnworth | |
| 5,411,400 A | * | 5/1995 | Subrahmanyan et al. | 439/68 |
| 5,539,200 A | * | 7/1996 | Lebby et al. | 283/49 |
| 5,570,273 A | * | 10/1996 | Siegel | 361/773 |
| 5,645,684 A | | 7/1997 | Keller | 156/643.1 |

(List continued on next page.)

FOREIGN PATENT DOCUMENTS

| | | |
|---|---|---|
| DE | 197 46 585 A | 4/1999 |
| EP | 0 490 530 A | 6/1992 |
| EP | 0 497 620 A | 8/1992 |
| JP | 57 161819 A | 10/1982 |

OTHER PUBLICATIONS

IBM Technical Disclosure, vol. 17, No 11, p. 6761 Apr. 1985.*

Jurgend Mohr: "LIGA_A Technology for Fabricating Microstructures and Microsystems" Sensors and Materials. vol. 10, No. 6, 1998, pp. 363–373, XP000878653. Tokyo.

(List continued on next page.)

*Primary Examiner*—Neil Abrams
(74) *Attorney, Agent, or Firm*—Haynes and Boone, LLP

(57) ABSTRACT

A system, apparatus, and method which enable microcomponents to be electrically coupled in a desirable manner are disclosed. More specifically, electrical coupling mechanisms are disclosed, which are suitable for providing an electrical coupling between two or more microcomponents. One electrical coupling mechanism provided herein, which may be utilized to provide a flexible coupling between two or more microcomponents, is a ribbon cable. Such a ribbon cable may include one or more electrically isolated conducting "rows," which may enable communication of electrical signals between two or more microcomponents coupled to such ribbon cable. An electrical connector, such as an electrical snap connector, is also provided herein, which is suitable for electrically coupling two or more microcomponents. Such an electrical connector may be utilized to couple a ribbon cable to a microcomponent or it may be utilized to directly couple two microcomponents in a manner that enables electrical communication therebetween. Furthermore, a "Z clamp" electrical connector is provided which allows for an engageable/disengageable electrical connection to be achieved between two or more microcomponents.

55 Claims, 12 Drawing Sheets

U.S. PATENT DOCUMENTS

| | | | | | |
|---|---|---|---|---|---|
| 5,657,516 | A | | 8/1997 | Berg et al. | |
| 5,660,680 | A | | 8/1997 | Keller | 438/50 |
| 5,806,152 | A | | 9/1998 | Saitou | 24/662 |
| 5,818,748 | A | | 10/1998 | Bertin | 365/51 |
| 5,848,456 | A | * | 12/1998 | Sjoqvist | 24/618 |
| 5,889,657 | A | * | 3/1999 | Kono | |
| 5,938,455 | A | * | 8/1999 | Glovatsky | 439/74 |
| 6,461,185 | B2 | * | 10/2002 | James | 439/352 |

OTHER PUBLICATIONS

A New Pick Up & Release Method By Heating For Micromanipulation, by Fumuhito Arai and Toshio Fukuda.

Advanced Parts Orientation System Has Wide Application, by H. Hitakawa.

Design, Fabrication, and Characterization of Single Crystal Silicon Latching Snap Features for Micro Assembly, by Rama Prasad, Karl–Friedrich Bohringer and Noel C. MacDonald.

Fluidic Self–Assembly of Microstructures and its Application to the Integration of GaAs on Si, by Hsi–Jen J. Yeh and John S. Smith.

Hexsil Tweezers for Teleoperated Microassembly, by C. G. Keller and R. T. Howe.

Microassembly Technologies for MEMS, by Michael B. Cohn et al.

Microfabricated High Aspect Ratio Silicon Flexures, by Chris Keller, 1998.

Self–Assembling Electrical Networks: An Application of Micromachining Technology, by Michael B. Cohn et al.

Surface–Micromachined Components for Articulated Microrobots, by Richard Yeh, et al.

Survey of Sticking Effects for Micro Parts Handling, by Ronald S. Fearing.

* cited by examiner

RIBBON CABLE AND ELECTRICAL CONNECTOR FOR USE WITH MICROCOMPONENTS

RELATED APPLICATIONS

This application is related to concurrently filed and commonly assigned U.S. patent application Ser. No. 09/569,330 entitled "METHOD AND SYSTEM FOR SELF-REPLICATING MANUFACTURING STATIONS," 09/570,170 entitled "SYSTEM AND METHOD FOR COUPLING MICROCOMPONENTS," and 09/569,329 entitled "GRIPPER AND COMPLEMENTARY HANDLE FOR USE WITH MICROCOMPONENTS," the disclosures of which are hereby incorporated herein by reference.

TECHNICAL FIELD

The present invention relates in general to mechanisms for electrically coupling two components, and in specific to a ribbon cable, an electrical connector, and a temporarily engageable/disengageable mechanism for electrically coupling microcomponents.

BACKGROUND

Extraordinary advances are being made in microelectronic devices and MicroElectroMechanical ("MEM") devices, which comprise integrated micromechanical and microelectronic devices. The terms "microcomponent" and "microdevice" will be used herein generically to encompass microelectronic components, as well as MEMs components. A need exists in the prior art for a mechanism for electrically coupling microcomponents.

In the prior art, integrated circuits ("ICs") are commonly implemented with a microcomponent (e.g., a MEMs component) hard wired to a bond pad (e.g., with electrical traces on the circuit). That is, the wiring electrically coupling microcomponents within an IC of the prior art is physically attached to the substrate and is not releasable therefrom. To electrically couple the microcomponents of one IC to those of another IC, for example, external wires are coupled from one IC to the bond pads of another IC. The bond pads provide a connection point for a wire typically 25 microns in diameter. A solder bump may be utilized, which is a ball of solder that is about 75 microns in diameter. Turning to FIG. 10, an example of such a prior art implementation is shown. In FIG. 10, a one centimeter die site 10 (which may be referred to as a "chip") is implemented having one or more MEMs components 12 included thereon. It should be understood that the die site may be any of various sizes commonly implemented in the prior art, but for illustrative purposes, a one centimeter die site is described in conjunction with FIG. 10. As further shown, the die site 10 includes bond pads 14, which are each typically approximately 50 to 100 microns in size. The MEMs components 12 are "hard wired" to the bond pads 14 with electrical traces 16. Thereafter, the MEMs components 12 may be electrically coupled to off-chip devices (i.e., devices off die site 10) through coupling wires to the appropriate bond pads.

As is well known in the prior art, the chip 10 is typically placed in a "chip carrier," which is the package for the chip. Thus, the entire one centimeter die 10 is placed in a package which provides wires to the outside world. Typically, a machine called a "wire bonder" connects each pad of the chip 10 to an appropriate pin on the package using wires 18. Wires 18 are each approximately 25 microns in size. Given that a MEMs component may be only 100 microns (or smaller) in size, the external wires 18 used to couple the bond pads to a pin on the package are relatively large in comparison with MEMs components 12.

The above-described prior art technique of coupling MEMs components of a chip to off-chip devices has many characteristics that are often undesirable in implementing MEMs components. First, the individual MEMs components are permanently hard-wired in a manner that does not permit the individual MEMs components to move (e.g., rotate and/or translate along a path) as may be desired for some implementations. Additionally, a disproportionately large amount of area is consumed by the wiring for coupling the MEMs components. For example, each external wire 18 of FIG. 10 is approximately 25 microns in size, wherein an individual MEM component 12 may be 100 microns (or less) in size. Accordingly, the wiring required for coupling the MEMs components to off-chip devices may consume more area than is required for the MEMs components themselves. As a result, the prior art technique of coupling microcomponents (e.g., MEMs components) does not allow for individual components to be electrically coupled to other devices in a flexible manner such that the components may maintain an electrical coupling as the components move (e.g., rotate and/or translate in some direction) relative to each other. Furthermore, the prior art technique of coupling microcomponents does not allow for individual components to be temporarily electrically coupled to another component in a manner such that the components may be electrically engaged for a period of time and then electrically disengaged for a period of time.

SUMMARY OF THE INVENTION

In view of the above, a desire exists for an electrical coupling mechanism suitable for electrically coupling microcomponents. A further desire exists for a relatively small-scale electrical coupling mechanism that is not disproportionately large in relation to the microcomponents being coupled. Still a further desire exists for a flexible electrical coupling mechanism that is capable of adapting to various positions to enable microcomponents to be flexibly coupled. For example, a desire exists for a flexible electrical coupling mechanism that enables microcomponents to maintain an electrical coupling as the components move (e.g., rotate and/or translate in some direction) relative to each other. Yet a further desire exists for an electrical coupling mechanism that enables individual components to be electrically engaged for a period of time and then electrically disengaged for a period of time. That is, a desire exists for an electrical coupling mechanism that may be utilized to engage and disengage a component to provide an electrical coupling in a desirable manner.

These and other objects, features and technical advantages are achieved by a system, apparatus, and method which enable microcomponents to be electrically coupled in a desirable manner. More specifically, electrical coupling mechanisms are disclosed, which are suitable for providing an electrical coupling between two or more microcomponents. One electrical coupling mechanism provided herein, which may be utilized to provide a flexible coupling between two or more microcomponents, is a ribbon cable. Such a ribbon cable may include one or more electrically isolated conducting "rows," which may enable communication of electrical signals between two or more microcomponents coupled to such ribbon cable. An electrical connector is also provided herein, which is suitable for electrically coupling two or more microcomponents. Such an electrical connector may be utilized to couple a ribbon cable to a microcomponent or it may be utilized to directly couple two microcomponents in a manner that enables electrical communication therebetween. Furthermore, a "Z clamp" electrical connector is provided which allows for an engageable/disengageable electrical connection to be achieved between two or more microcomponents.

The electrical coupling mechanisms of the present invention may be integrated within a microcomponent to enable the microcomponent to be electrically coupled to another microcomponent. For example, a MEMs component may be fabricated having an electrical connector (e.g., ribbon cable, connector, and/or Z clamp connector) included therewith to enable the MEMs component to obtain a desired electrical coupling to one or more other MEMs components. Furthermore, the electrical coupling mechanisms may be implemented as an integrated part between two or more microcomponents. For example, two or more MEMs components may be fabricated having an electrical coupling mechanism as an integrated component that electrically couples such two or more components. Alternatively, the electrical coupling mechanisms of the present invention may be implemented as stand-alone mechanisms that may then be used to provide a desired electrical coupling between two or more microcomponents.

The electrical coupling mechanisms of the present invention may be fabricated utilizing any of various fabrication techniques, including, as examples, those fabrication processes disclosed in U.S. Pat. No. 4,740,410 issued to Muller et al. entitled "MICROMECHANICAL ELEMENTS AND METHODS FOR THEIR FABRICATION," U.S. Pat. No. 5,660,680 issued to Chris Keller entitled "METHOD FOR FABRICATION OF HIGH VERTICAL ASPECT RATIO THIN FILM STRUCTURES." U.S. Pat. No. 5,645,684 issued to Chris Keller entitled "MULTILAYER HIGH VERTICAL ASPECT RATIO THIN FILM STRUCTURES," as well as the fabrication process disclosed in concurrently filed and commonly assigned U.S. patent application Ser. No. 09/569,330 entitled "METHOD AND SYSTEM FOR SELF-REPLICATING MANUFACTURING STATIONS," the disclosure of which is hereby incorporated herein by reference. However, other fabrication processes may be utilized, as well, and the scope of the present invention is intended to encompass electrical coupling mechanisms for use with microcomponents irrespective of the fabrication process utilized to develop such mechanisms. Recent developments have allowed for fabrication of "releasable" microcomponents (e.g., stand-alone microcomponents that may be released or removed from the wafer). For example, the fabrication process disclosed in concurrently filed and commonly assigned U.S. patent application Ser. No. 09/569,330 entitled "METHOD AND SYSTEM FOR SELF-REPLICATING MANUFACTURING STATIONS" allows for fabrication of releasable microcomponents. Furthermore, such fabrication process also allows for the fabrication of electrically isolated microcomponents. Additionally, other fabrication processes may be developed in the future, which may also allow for releasable microcomponents.

The electrical coupling mechanisms disclosed herein are suitable for coupling such releasable, stand-alone microcomponents. Of course, the electrical coupling mechanisms of the present invention may be implemented for any type of microcomponent, including both released and non-released microcomponents, and any such implementation is intended to be within the scope of the present invention. Given that such releasable microcomponents have only recently become possible, little advance has been made in the prior art toward electrical coupling mechanisms that are suitable for such releasable microcomponents. Releasable microcomponents may in some implementations have characteristics that should be taken into account in electrically coupling the microcomponents, which have not been an issue in the non-releasable microcomponents common in the prior art,. For example, releasable microcomponents may move in relation to each other (i.e., translate and/or rotate in relation to each other), and an electrical coupling should be utilized to allow for such desired movement.

Additionally, releasable microcomponents may be implemented in a manner such that the components are coupled out-of-plane with respect to each other, whereas non-releasable microcomponents of the prior art are generally only coupled in-plane (i.e., in the plane of the wafer of the microcomponents). Accordingly, electrical coupling mechanisms may be utilized to form an out-of-plane electrical coupling between two or more microcomponents. The electrical coupling mechanisms disclosed herein are suitable for use in various implementations of releasable microcomponents. For example, a ribbon cable, electrical connector, and/or a Z clamp connector may be utilized in electrically coupling such releasable microcomponents. For instance, the electrical coupling mechanisms disclosed herein may be implemented to allow for two or more microcomponents that move relative to one another to be electrically coupled. The electrical coupling mechanisms of the present invention may also be utilized to allow microcomponents to be electrically coupled in-plane or out-of-plane. For example, the electrical coupling mechanisms may be utilized to enable an electrical connection between microcomponents that are pulled off a wafer and coupled at 90 degrees to each other.

It should be appreciated that a technical advantage of one aspect of the present invention is that electrical coupling mechanisms suitable for electrically coupling microcomponents are provided. Another technical advantage of one aspect of the present invention is that electrical coupling mechanisms may be implemented to enable a relatively small-scale coupling between two or more microcomponents. For example, electrical coupling mechanisms disclosed herein may be implemented in a manner such that the coupling mechanism does not consume a disproportionately large amount of area in relation to the coupled microcomponents, as is common with the external wiring commonly implemented in prior art coupling techniques. A further technical advantage of one aspect of the present invention is that a flexible electrical coupling mechanism that is capable of adapting to various positions to enable microcomponents to be flexibly coupled is disclosed. For example, a ribbon cable is disclosed which may be implemented to provide a desired flexible electrical coupling between two or more microcomponents. In some implementations, bond pads may still be utilized to provide an electrical coupling, although the flexible electrical coupling mechanisms disclosed herein, such as a ribbon cable, enable for an electrical coupling between two or more microcomponents that is not physically attached to the substrate, as with prior art implementations.

Still a further technical advantage of one aspect of the present invention is that an electrical coupling mechanism is disclosed which enables an engageable/disengageable electrical connection between two or more microcomponents. For example, a Z clamp is disclosed which may be utilized to engage and disengage an electrical connection with a microcomponent, as desired. Accordingly, electrical coupling mechanisms are disclosed that enable an electrical connection to be achieved between two or more microcomponents in an unobtrusive manner. Yet a further technical advantage of one aspect of the present invention is that electrical coupling mechanisms are disclosed, which are suitable for electrically coupling microcomponents that are releasable/removable from the wafer ("releasable microcomponents").

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

A preferred embodiment provides a small-scale (e.g., micron-scale or sub-micron scale) ribbon cable, which is essentially a scaled-down version of a large-scale ribbon cable commonly implemented for printers or other devices in which flexible electrical wiring is desirable. That is, large-scale ribbon cables are commonly implemented in the prior art to provide a flexible electrical coupling between two large-scale components. For instance, ribbon cables are commonly utilized to provide an electrical coupling from a first part to a second part that is movable relative to the first part. As one example, large-scale ribbon cables are commonly implemented to electrically couple a print head to the processor of a printer to enable the print head to receive electrical signals from the processor as the print head advances back and forth across the width of a sheet of paper. As is well-known in the large-scale arena, large-scale ribbon cables have been adapted for many other implementations in which flexible electrical coupling is desired. Ribbon cables typically provide a plurality of wires (i.e., two or more wires) that are electrically isolated from each other, such that independent electrical signals may be transmitted over each wire.

Figure 1:
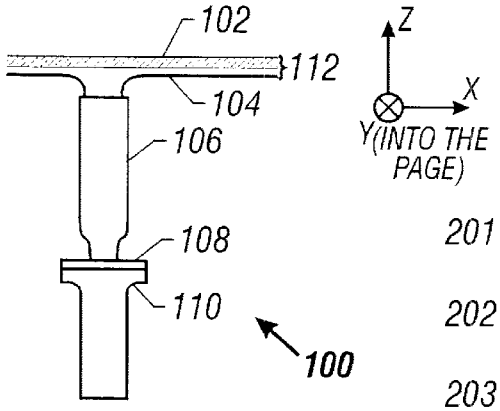
FIG. 1 shows a side view of an exemplary implementation of a preferred embodiment of a micron-scale ribbon cable.

Turning to FIG. 1, an exemplary implementation of a preferred embodiment is shown. FIG. 1 provides a side view of a micron-scale ribbon cable 100 which includes a conductor material 102 for carrying electrical signals. In a most preferred embodiment, the conducting material 102 is gold. However, in alternative embodiments the conducting material 102 may be any suitable conducting material now known or later developed, and any such embodiment is intended to be within the scope of the present invention. The conducting material 102 is supported underneath by the second layer of polysilicon (i.e., "poly 2"), which is labeled 104 in FIG. 1. As will be better understood with the below description of FIG. 2, the conducting material 102 and poly 2 layer 104 together form an electrically isolated conducting "row" of the ribbon cable 100. In a preferred embodiment, the thickness 112 (or "depth") of the conducting row is relatively thin to allow the conducting row flexibility. For example, the thickness 112 of the conducting row is preferably thin to enable the ribbon cable 100 sufficient flexibility to bend upward and/or downward (i.e., along the "Z" axis of FIGS. 1 and 2) without breaking. Furthermore, having a conducting row that is relatively thin may enable the ribbon cable sufficient flexibility to twist or otherwise contort somewhat to adapt to a needed position for maintaining an electrical connection with a MEMs component without the conducting row breaking. In a most preferred embodiment, the thickness 112 of a conducting row of the ribbon cable 100 is approximately 1 to approximately 3 microns ($\mu$m). However, in alternative embodiments, the thickness 112 may be smaller or larger than approximately 1 $\mu$m to approximately 3 $\mu$m, and any such embodiment is intended to be within the scope of the present invention.

Below the poly 2 layer 104 is a first layer of polysilicon (i.e., "poly 1"), which is labeled 106 in FIG. 1. Most preferably, the poly 1 layer 106 is a column that is electrically connected to the poly 2 layer 104. Under the poly 1 layer 106 is an insulating layer 108, which is most preferably a nitride layer. However, in alternative embodiments the insulating layer 108 may be any suitable insulating material now known or later developed, and any such embodiment is intended to be within the scope of the present invention. Mechanically coupled below the insulating layer 108 is a mold rib 110. It should be recognized that the ribbon cable 100 of a preferred embodiment may be fabricated using the process disclosed in concurrently filed and commonly assigned U.S. patent application Ser. No. 09/569,330 entitled "METHOD AND SYSTEM FOR SELF-REPLICATING MANUFACTURING STATIONS." Of course any other suitable fabrication process now known or later developed may be utilized.

Figure 2:
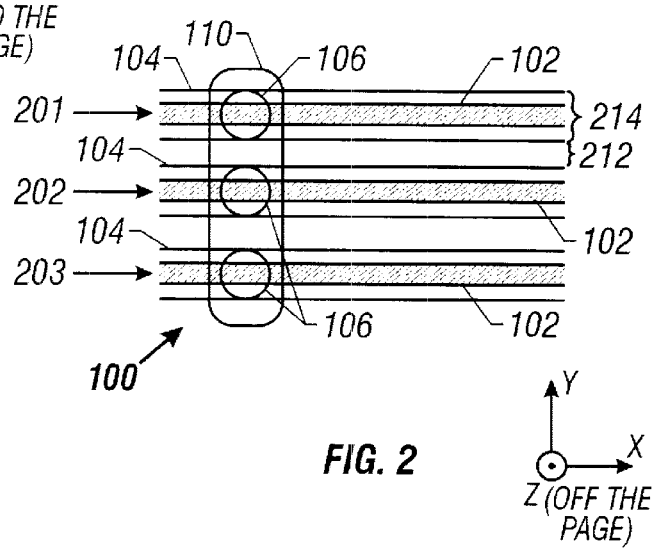
FIG. 2 shows a top view of the exemplary ribbon cable implementation of FIG. 1.

Turning to FIG. 2, a top view of the ribbon cable 100 of a preferred embodiment is shown. Just as large-scale ribbon cables typically include a plurality of wires, the ribbon cable of a preferred embodiment includes a plurality (i.e., two or more) of isolated conducting surfaces 102, which in the exemplary implementation of FIG. 2 are shown as 201, 202, and 203. It should be understood, however, that the present invention is intended to encompass a ribbon cable having any number of electrically isolated conducting surfaces, i.e., one or more of such surfaces. As shown in FIG. 2, each row 201, 202, and 203 of ribbon cable 100 includes a conducting material 102 (e.g., gold), poly 2 layer 104, and poly 1 layer 106. Furthermore, the rows 201, 202, and 203 are all coupled to a common mold rib 110, which is electrically insulated from each row by the insulating layer 108 (not shown in FIG. 2). Mold rib 110 acts as a base that provides the plurality of isolated conducting surfaces a common "bond." That is, the mold rib 110 groups the plurality of isolated conducting surfaces into a common ribbon cable. Accordingly, a ribbon cable 100 having a plurality of electrically isolated conducting surfaces 102 coupled to a common mold rib 110 is provided in a preferred embodiment.

In a preferred embodiment, a separation, shown as 212, is provided between each row (e.g., 201, 202, and 203) of the ribbon cable to reduce the possibility of two or more of the electrically isolated conducting surfaces 102 shorting together (i.e., not maintaining their electrical independence). In a most preferred embodiment, separation 212 is provided between each row of the ribbon cable 100, and such separation 212 is approximately 6 $\mu$m to approximately 12 $\mu$m. However, in alternative embodiments, the separation 212 may be smaller or larger than approximately 6 $\mu$m to approximately 12 $\mu$m, and any such embodiment is intended to be within the scope of the present invention. Furthermore, in alternative embodiments, a suitable insulating material (that is sufficiently flexible) may be implemented between each conducting row of the ribbon cable 100 if a fabrication process is utilized that allows for such insulating rows to be implemented in that manner. That is, rather than relying solely on a separation distance 212 to prevent the conducting rows from shorting together, suitable insulating material may be implemented between each row in alternative embodiments, and any such embodiment is intended to be within the scope of the present invention.

Also, in a preferred embodiment, each conducting row of the ribbon cable (e.g., rows 201, 202, and 203) have a width 214 that is sufficiently wide enough to provide a desired amount of stiffness along the "Y" axis of FIGS. 1 and 2. That is, the width 214 provides a desired amount of stiffness/flexibility in bending from side to side for each conducting row. In a most preferred embodiment, the width 214 of a conducting row of the ribbon cable 100 is greater than or equal to 8 $\mu$m to provide a sufficient amount of stiffness. However, in alternative embodiments, the width 214 may be smaller than 8 $\mu$m, and any such embodiment is intended to be within the scope of the present invention. Thus, it should be recognized that the thickness 112 (as shown in FIG. 1) may be adjusted to control the flexibility of each row of the ribbon cable upward/downward (i.e., along the Z axis of FIGS. 1 and 2), and the width 214 (as shown in FIG. 2) may be adjusted to control the flexibility of each row of the ribbon cable from side to side (i.e., along the Y axis of FIGS. 1 and 2). In a most preferred embodiment, the thickness 112 is sufficiently thin to allow the ribbon cable 100 flexibility in the out-of-plane direction (i.e., upward/downward along the Z axis of FIGS. 1 and 2), and the width 214 of each row of the ribbon cable is sufficiently large to make each row relatively stiff in the in-plane direction (i.e., side to side along the Y axis of FIGS. 1 and 2). It should be recognized that in a most preferred embodiment, each conducting row of the ribbon cable is smaller than the external wires typically used in the prior art for electrically coupling microcomponents. Accordingly, in a most preferred embodiment, the ribbon cable provides conducting rows that are not so disproportionate in size relative to the microcomponents being coupled thereby.

Figure 3:
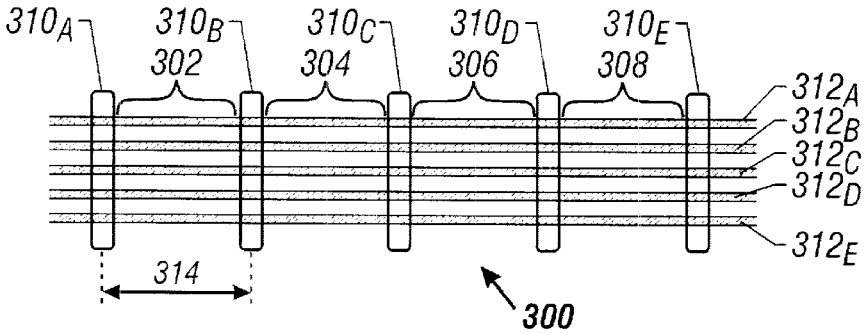
FIG. 3 shows an exemplary implementation of a preferred embodiment of a micron-scale ribbon cable having an extended length.

It should be understood that a ribbon cable of a preferred embodiment may be implemented having any length. Thus, for example, a ribbon cable of a preferred embodiment may be implemented as several hundred $\mu$m or several millimeters in length. FIG. 3 shows an exemplary implementation of a preferred embodiment having an extended length. For example, the portion of ribbon cable 300 of FIG. 3 may be approximately 400 $\mu$m in length. Of course, a ribbon cable of a preferred embodiment may be implemented in a similar manner to be extended to any length, and any length of a ribbon cable is intended to be encompassed within the scope of the present invention.

In the exemplary implementation of FIG. 3, five conducting rows $\mathbf{312}_A$, $\mathbf{312}_B$, $\mathbf{312}_C$, $\mathbf{312}_D$, and $\mathbf{312}_E$ are included in the ribbon cable 300. Of course, any number of such conducting rows may be implemented within the ribbon cable 300, and any such implementation is intended to be within the scope of the present invention. As shown in FIG. 3, multiple mold ribs may be provided along the length of the ribbon cable of a preferred embodiment. For example, mold ribs $\mathbf{310}_A$, $\mathbf{310}_B$, $\mathbf{310}_C$, $\mathbf{310}_D$, and $\mathbf{310}_E$ are implemented along the length of ribbon cable 300 to form segments 302, 304, 306, and 308 of ribbon cable 300. It should be recognized that any number of mold ribs may be implemented in a similar manner to form any number of segments in various implementations, and any such implementation is intended to be within the scope of the present invention. The multiple mold ribs may be implemented along the length of ribbon cable 300 to aid in maintaining a desired rigidity along the ribbon cable 300, as well as aiding in maintaining each conducting row electrically isolated from the other conducting rows (i.e., preventing the conducting rows from shorting together). In a most preferred embodiment, the separation distance 314 between each mold rib is approximately 96 $\mu$m. However, in alternative embodiments, the separation distance 314 between each mold rib may be more or less than approximately 96 $\mu$m to provide a desired amount of rigidity along the ribbon cable 300, and any such embodiment is intended to be within the scope of the present invention.

It should be understood that each segment 302, 304, 306, and 308 may include a conducting row (or "conducting wire"), such as the conducting rows described above in conjunction with FIGS. 1 and 2. As described above in conjunction with FIGS. 1 and 2, each of the conducting rows may include both a conducting material 102 (e.g., gold) and a polysilicon layer 104 (e.g., poly 2 layer). However, in alternative embodiments, each conducting row may consist only of the conducting material 102 (e.g., gold). For example, each conducting row $\mathbf{312}_A$, $\mathbf{312}_B$, $\mathbf{312}_C$, $\mathbf{312}_D$, and $\mathbf{312}_E$ of FIG. 3 may consist only of a conducting material. Such an implementation may be desirable to allow for increased flexibility in the ribbon cable. For example, the stiffness of the poly 2 layer 104 of the implementation of FIGS. 1 and 2 is generally greater than that of the conducting material 102 (e.g., gold). Accordingly, as the ribbon cable is bent, a radius may eventually be reached in which the poly 2 layer 104 gets beyond its yield strength and breaks (i.e., reaches its brittle failure point). That is, the poly 2 layer 104 may limit the flexibility of the ribbon cable.

Figure 4A:
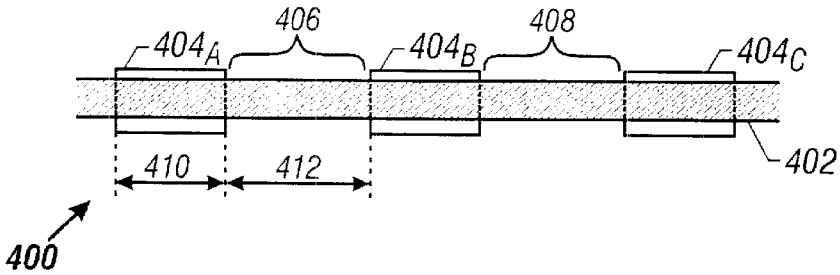
FIG. 4A shows a top view of an exemplary implementation of a conducting row included within a ribbon cable of an alternative embodiment.
Figure 4B:
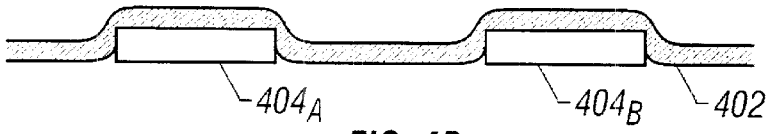
FIG. 4B shows a side view of the exemplary conducting row implementation of FIG. 4A.

Thus, in an alternative embodiment, the conducting row may be implemented such that it consists solely of the conducting material 102 (e.g., gold), at least along portions of the length of the ribbon cable. Turning to FIGS. 4A and 4B, an exemplary implementation of an alternative embodiment for a conducting row 400 is shown, wherein the polysilicon layer is eliminated from some stretches of the length (or "run") of the ribbon cable. FIG. 4A shows a top view of an exemplary implementation of a conducting row 400 that is included in the ribbon cable of an alternative embodiment, and any number of such conducting rows 400 may be included within the ribbon cable of this alternative embodiment. For example, five such conducting rows 400 may be included within the ribbon cable, as shown in FIG. 3. As shown, the conducting row 400 includes a conducting material 402 for carrying/communicating electrical signals. In this alternative embodiment, multiple supporting layers (e.g., poly 2 layers), which may also be referred to as supporting ribs, may be provided along the length of the conducting row 400. That is, the supporting layer along the length of the conducting row may be non-contiguous.

For example, supporting layers $\mathbf{404}_A$, $\mathbf{404}_B$, and $\mathbf{404}_C$ are implemented along the length of conducting row 400 to form segments (which may be referred to as "sub-segments") to 406 and 408 of conducting row 400. It should be recognized that the portion of the conducting row 400 shown in FIG. 4A may be included within a segment of the ribbon cable, such as one of segments 302, 304, 306, or 308 shown in FIG. 3. Accordingly, the segments 406 and 408 formed by the supporting layers along the conducting row may be referred to as "sub-segments" or "segments of the conducting row," as opposed to "segments of the ribbon cable," which refers to those segments 302, 304, 306, and 308 shown in FIG. 3.

It should be recognized that any number of supporting layers may be implemented in a similar manner to form any number of sub-segments along the conducting row 400 in various implementations, and any such implementation is intended to be within the scope of the present invention. The multiple support layers may be implemented along the length of conducting row 400 to aid in maintaining a desired rigidity along the conducting material 402, as well as aiding in maintaining each conducting row electrically isolated from the other conducting rows (i.e., preventing the conducting rows from shorting together). The separation distance 412 between each support layer is most preferably from approximately 3 $\mu$m to approximately 5 $\mu$m. However, in various implementations the separation distance 412 between each support layer may be less than approximately 3 $\mu$m or more than approximately 5 $\mu$m to provide a desired amount of rigidity along the conducting row 400, and any such implementation is intended to be within the scope of the present invention. Furthermore, the length 410 of each support layer (e.g., support layers $\mathbf{404}_A$, $\mathbf{404}_B$, and $\mathbf{404}_C$) is most preferably from approximately 3 $\mu$m to approximately 5 $\mu$m. However, in various implementations the length 410 of each support layer may be less than approximately 3 $\mu$m or more than approximately 5 $\mu$m to provide a desired amount of rigidity along the conducting row 400, and any such implementation is intended to be within the scope of the present invention.

FIG. 4B provides a side view of the exemplary implementation of FIG. 4A. As shown in FIG. 4B, the conducting material 402 is preferably fabricated over the supporting layers $\mathbf{404}_A$, $\mathbf{404}_B$, and $\mathbf{404}_C$. However, in various other implementations, the supporting layers $\mathbf{404}_A$, $\mathbf{404}_B$, and $\mathbf{404}_C$ may be implemented in any other manner now known or later developed, and any such implementation is intended to be within the scope of the present invention. It should be recognized that the alternative embodiment of FIGS. 4A and 4B may provide a ribbon cable that has a large amount of flexibility in that the majority of the bend of the conducting rows may be directed to conducting material 102, which is generally much more malleable than the polysilicon support layers $\mathbf{404}_A$, $\mathbf{404}_B$, and $\mathbf{404}_C$. As a result, a much tighter (or smaller) radius may be achieved in the bend of the ribbon cable without incurring a brittle fracture of the supporting polysilicon layers $\mathbf{404}_A$, $\mathbf{404}_B$, and $\mathbf{404}_C$.

It should be recognized that the above-described embodiments provide a ribbon cable that may be utilized to provide a flexible electrical coupling between two or more microcomponents (e.g., MEMs components). That is, a ribbon cable is provided that is capable of providing electrical conductivity between two or more microcomponents with very little mechanical hindrance being associated with the ribbon cable coupling. For example, the ribbon cable may be utilized to provide electrical conductivity between parts that are moveable, such as parts that rotate and/or translate along a path (similar to that of a print head in a printer). Just as large-scale ribbon cables have provided a much needed flexible electrical coupling that may be utilized in a variety of implementations/situations in which such flexible coupling is desirable, the small-scale ribbon cable of the present invention may likewise be utilized to provide flexible electrical coupling in a variety of implementations/situations in which such flexible coupling is desireable.

The small-scale ribbon cable of the present invention may be implemented as an integrated component part of a microcomponent. For example, a MEMs component may be fabricated having a ribbon cable included therewith to enable the MEMs component to obtain a flexible electrical coupling to one or more other MEMs components. For instance, the layout for the MEMs component may include a ribbon cable to be fabricated therewith. Furthermore, such small-scale ribbon cable may be implemented as an integrated part between two or more microcomponents. For example, two or more MEMs components may be fabricated having a ribbon cable coupling such two or more components. Alternatively, such small-scale ribbon cable may be implemented as a stand-alone component that may then be used to provide a flexible electrical coupling between two or more microcomponents.

In view of the above, it should be recognized that some type of electrical connector may be provided on one or both ends of the ribbon cable to aid in coupling the ribbon cable to one or more microcomponents. One type of connector that is suitable for use with microcomponents is a connector. For example, connectors suitable for use with microcomponents are disclosed in concurrently filed and commonly assigned U.S. patent application Ser. No. 09/570,170 entitled "SYSTEM AND METHOD FOR COUPLING MICROCOMPONENTS," the disclosure of which is hereby incorporated herein by reference. As described in greater detail below, such connectors may be implemented as electrical connectors to provide an electrical coupling between two microcomponents. Accordingly, such electrical connectors may be included on one or both ends of the ribbon cable disclosed herein for coupling such ribbon cable to one or more microcomponents.

It should be understood that an electrical snap connector is one type of connector suitable for providing an electrical coupling between two or more microcomponents, and any type of electrical snap connector now known or later discovered may be implemented to provide such an electrical coupling. For example, any of the various connector embodiments disclosed in "SYSTEM AND METHOD FOR COUPLING MICROCOMPONENTS" may be implemented as an electrical connector, including the preloaded snap connectors, non-preloaded snap connectors, and squeeze connectors. It should be understood, however, that various other types of connectors may be suitable for providing an electrical coupling between two or more microcomponents, and the present invention is not intended to be limited solely to the electrical snap connectors disclosed herein. For example, any suitable connector for providing an electrical coupling between a ribbon cable, as disclosed herein, and a microcomponent is intended to be within the scope of the present invention. Thus, the present invention is not intended to be limited only to electrical snap connectors provided herein, but rather such electrical snap connectors are intended solely as examples that render the disclosure enabling for many other suitable electrical connectors that may be utilized.

Figure 11A:
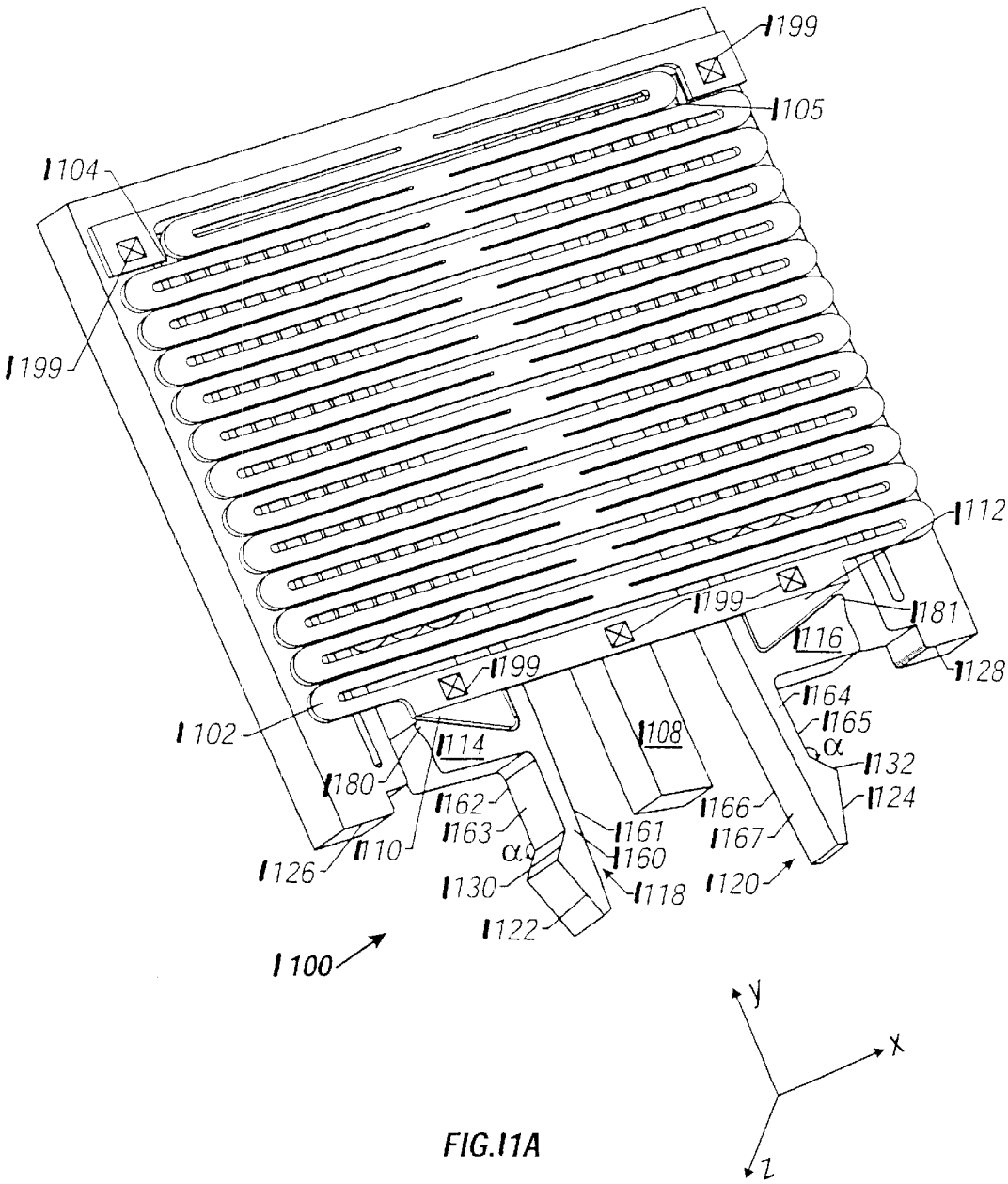
FIG. 11A shows an exemplary implementation of a single release preload snap connector.
Figure 11B:
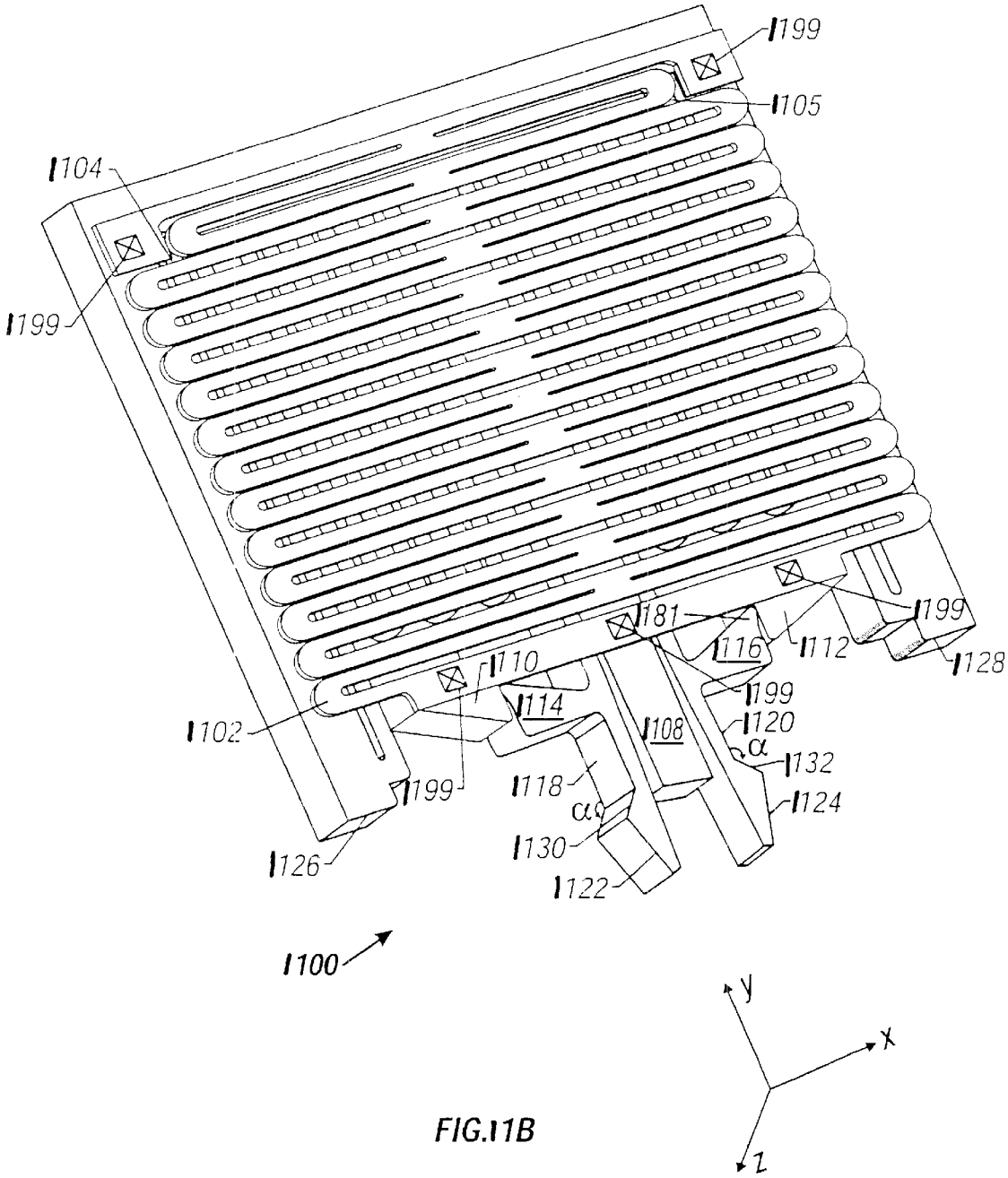
FIG. 11B shows an exemplary implementation of a single release preloaded snap connector that is "preloaded."

For instance, example connectors that may be used are described hereafter in conjunction with FIGS. 11A, 11B, 12, 13A, 13B and 14, which are also depicted and described in U.S. patent application Ser. No. 09/570,170 entitled "SYSTEM AND METHOD FOR COUPLING MICROCOMPONENTS." Turning to FIGS. 11A and 11B, an exemplary implementation of a "preloaded" snap connector of a preferred embodiment of the present invention is shown. More specifically, FIGS. 11A and 11B illustrate an exemplary single release preloaded snap connector 1100. Such a single release preloaded snap connector basically comprises a spring latching mechanism that holds the snap connector's arms into position after they have been "loaded" or compressed. As shown in FIG. 11A, the single release preloaded snap connector 1100 comprises three springs: 1104, 1105 and 1102. Springs 1104 and 1105 are shown below the surface layer and act in the X direction of FIG. 11A, and spring 1102 acts in the Y direction. As further shown in FIG. 11A, springs 1104 and 1105 form arms 1118 and 1120 of the snap connector 1100. As an exemplary operation of coupling a microcomponent that includes the preloaded snap connector 1100 to another microcomponent, one would use a relatively high-force gripper, such as tweezers, to grip arms 1118 and 1120 and compress them toward each other (i.e., along the X axis of FIG. 11A). As arms 1118 and 1120 are compressed, latching members 1114 and 1116 are moved inward to a point at which they are held in place by retaining members 1110 and 1112, as shown in FIG. 11B. At this point, the snap connector is said to be "preloaded." In a most preferred embodiment, such a relatively high force gripper may be capable of providing a compression force of approximately 500 microNewtons to approximately 5,000 microNewtons, for example. Further, in a most preferred embodiment, such preloaded snap connector 1100 may require approximately 500 microNewton compression force, as an example, to be applied by such a gripper to preload such snap connector 100. The single release preloaded snap connector 100 also includes a single release mechanism (or "trigger") 1108, which may be pressed upward in the Y direction of FIG. 11A to release the latching members 1114 and 1116 from the retaining members 1110 and 1112. In a most preferred embodiment, a force of approximately one hundred microNewtons may be applied to cause such a release of from the retaining members, for example.

As illustrated in FIG. 11A, arms 1118 and 1120 include barbed ends which have "insertion sides" 1122 and 1124. As further shown, the barbed ends also include retention sides 1130 and 1132, which may be angled relative to their respective arms to aid in retaining the snap connector coupled to a mating component. That is, retention sides 1130 and 1132 may have an appropriate angle to maintain the snap connector fastened to the mating component in a desirable manner. For example, as shown in FIGS. 11A and 11B the retention sides 1130 and 1132 may be at an angle a to their respective arms 1118 and 1120, which may enable the snap connector 1100 to securely "lock" into the mating component (i.e., not be easily disengaged from the mating component). However, in other implementations the angle a of retention sides 1130 and 1132 may vary in order to vary the "secureness" of the snap connector. For instance, a 90 degree angle a may be utilized to provide a permanent coupling, while other angles a may be implemented for retention sides 1130 and 1132 to enable a temporary/removable (or "disengageable") coupling.

Most preferably, when the snap connector 1100 is preloaded, the barbed ends of snap connector 1100 are positioned to enable relatively easy insertion (e.g., requiring relatively little insertion force) of the barbed ends through apertures of a mating component (e.g., apertures 1250 and 1252 of mating component 1200 in FIG. 2). Most preferably, insertion sides 1122 and 1124 of preloaded snap connector 1100 do not contact the edges of a mating component's apertures during coupling. As a result, if the snap connector is properly aligned respective to a mating component, friction from contact of the snap connector's barbed ends with the edges of the mating component's apertures may be eliminated, thereby reducing the amount of insertion force required to couple the snap connector with the mating component. In a most preferred embodiment, an insertion force of approximately one hundred microNewtons, as an example, may be utilized to successfully couple the preloaded snap connector 1100 with a mating component. As also shown in FIG. 11A, insertion sides 1122 and 1124 may be angled to aid in self-aligning of the snap connector with the mating component, assuming that the snap connector and mating component are misaligned when coupling.

Figure 12:
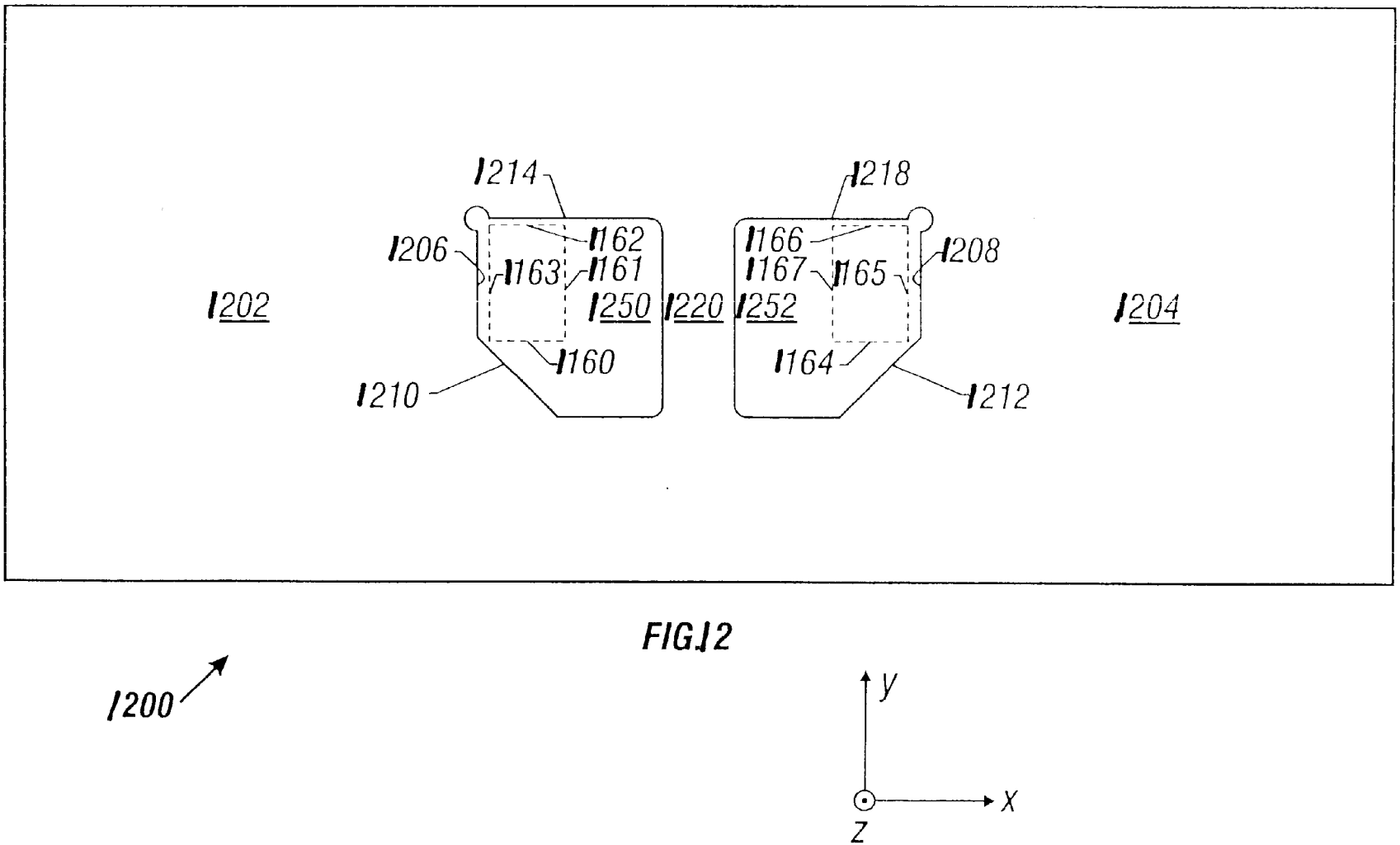
FIG. 12 shows an exemplary mating component that comprises apertures for receiving the single release preloaded snap connector of FIGS. 11A and 11B.

Turning to FIG. 12, an exemplary mating component 1200 having apertures 1250 and 1252 is shown. In operation, once the snap connector 1100 is preloaded (as shown FIG. 11B), the barbed ends of arms 1118 and 1120 are inserted through apertures 1250 and 1252 of mating component 1200. As the barbed ends are inserted, release mechanism 1108 engages (or "contacts") the "blocking surface" 1220 of mating component 1200, thereby releasing the latching mechanisms 1114 and 1116 from the retaining mechanisms 1110 and 1112. That is, as release mechanism 1108 is forced upward (due to the insertion force being applied which causes the release mechanism 1108 to engage the blocking surface 1220), spring 1102 compresses, thereby moving the retaining members 1110 and 1112 (which are coupled to spring 1102) upward. Thus, when the spring 1102 compresses such that retaining members 1110 and 1112 are moved upward to disengage latching members 1114 and 1116, latching members 1114 and 1116 return outward as springs 1104 and 1105 relax. That is, when latch members 1114 and 1116 disengage retaining members 1110 and 1112, springs 1104 and 1105 cause the arms 1118 and 1120 to return outward toward their "unloaded" position (i.e., the position of FIG. 11A), which is the biased position for the springs 1104 and 1105.

At that point, in a preferred embodiment, arm 1118 applies a force toward side 1206 of the mating component 1200, and arm 1120 applies a force toward side 1208 of mating component 1200. In a most preferred embodiment, arms 1118 and 1120 each apply a force of approximately one hundred fifty microNewtons to approximately two hundred microNewtons, as an example, toward sides 1206 and 1208, respectively. In a preferred embodiment, front side 1160 of arm 1118 engages angled side (or "wedge side") 1210 of aperture 1250, and back side 1162 engages side 1214 of aperture 1250. Likewise, in a preferred embodiment, front side 1164 of arm 1120 engages angled side (or "wedge side") 1212 of aperture 1252, and back side 1166 engages side 1218 of aperture 1252. As shown in phantom in FIG. 12, sides 1163 and 1161 of arm 1118 and sides 1165 and 1167 of arm 1120 may not actually engage (or contact) sides of apertures 1250 and 1252 in a preferred embodiment. However, in alternative embodiments, the snap connector's arms and/or the mating component's apertures may be implemented such that the sides of the arms do engage the sides of the apertures 1250 and 1252. For example, an implementation may be desirable in which engagement of the sides of the snap connector's arms and the sides of the apertures is desirable in that it provides an increased amount of surface area in contact, thereby increasing the amount of force required to disengage the snap connector from the mating component.

Additionally, the retaining surfaces 1130 and 1132 of the barbed ends engage the underside of mating component 1200, and the "constrained surfaces" 1126 and 1128 of snap connector 1100 come into contact with the "complementary surfaces" 1202 and 1204 of mating component 1200. In the exemplary implementation of FIG. 11A, the retaining surfaces 1130 and 1132 apply a force against the underside of the mating component to aid in maintaining the snap connector having a secure connection (e.g., such that the constrained surface 1126 and 1128 are maintained flush against the complementary surfaces 1202 and 1204 of the mating component). As a result, the snap connector 1100 works to securely couple its associated component to the mating component 1200.

It should be recognized that such a snap connector 1100 may be utilized for general assembly of microcomponents. That is, snap connector 1100 is suitable not only for in-plane, 2-D assembly, but is also suitable for performing out-of-plane, 3-D assembly of microcomponents. When utilized for out-of-plane, 3-D assembly of microcomponents, the snap connector of a preferred embodiment can be utilized to restrict all three degrees of freedom between the coupled components. When utilized for in-plane, 2-D assembly, the snap connector may provide only a reduced restriction of the degrees of freedom between the coupled components (i.e., may restrict only two degrees of freedom). In a preferred embodiment, snap connector 1100 enables out-of-plane, 3-D assembly to be achieved in a manner that enables components to be securely coupled. Thus, a microcomponent may be "picked up" out of the plane of a mating component and securely assembled to such mating component, resulting in a 3-D device. For example, one component on a wafer may be "picked up" off the wafer, rotated such that it is normal to a mating component on such wafer, and then securely coupled to the mating component.

As shown in the exemplary implementation of FIGS. 11A, 11B, and 12, the secure coupling provided between the snap connector 1100 and the mating aperture may restrict all three degrees of linear freedom of the coupled components, respective to each other, as well as restricting rotational degrees of freedom with respect to each other. Accordingly, the snap connector 1100 works to prevent the coupled components from moving linearly with respect to each other to prevent such coupled components from disengaging. More specifically, the snap connector works to prevent one of the coupled components from moving in either the X, Y, or Z directions of FIGS. 11A and 11B with respect to the other coupled component. More specifically, the snap connector 1100 and the mating component's apertures (which may also be referred to as "receptacles") work together to prevent such movement in a preferred embodiment. That is, both components may together move in either the X, Y, or Z directions, but the snap connector and mating component apertures work to prevent only one of the coupled components from moving in such directions without the other component also moving in such directions. Furthermore, the snap connector and mating component apertures work to prevent the coupled components from rotating respective to each other. That is, both components may together rotate, but the snap connector, in combination with the mating component apertures, works to prevent only one of the coupled components from rotating without the other component also rotating in a like manner.

It should also be recognized that the snap connector's springs and barbed ends, as well as the aperture of the mating component, may be implemented to aid in allowing the snap connector to be self-positioning or self-centering with the mating component. For example, the innerwalls 1210, 1212, 1214, and 1218 of apertures 1250 and 1252 of FIG. 12 are designed to receive the barbed ends of snap connector 1100 (which have insertion sides 1122 and 1124 that may aid in self-aligning the snap connector 1100 with the mating component). Additionally, springs 1104 and 1105 also aid in the self-aligning of the snap connector 1100 by enabling the arms 1118 and 1120 some flexibility along the X axis of FIGS. 11A and 11B. Such self-aligning is a desirable feature to aid in precise assembly of the microcomponents. For example, if positional assembly is being performed with no feedback to the assembly mechanism (i.e., the assembly is dependent on the accurate positioning of the components to be assembled), such self-aligning feature is desirable because it allows for small positional errors to be present for the components to be assembled.

Also, it should be recognized that the snap connector's springs may be fabricated in separate layers of the snap connector 1100. For instance, springs 1104 and 1105, which operate in the X direction, may be in polysilicon layer 1 of the snap connector, and the spring 1102, which operates in the Y direction, may be in polysilicon layer 2 (thus, overlaying springs 1104 and 1105). Various fabrication techniques may be utilized to achieve the springs in differing layers, including, as examples, those fabrication processes disclosed in U.S. Pat. No. 4,740,410 issued to Muller et al. entitled "MICROMECHANICAL ELEMENTS AND METHODS FOR THEIR FABRICATION," U.S. Pat. No.

5,660,680 issued to Chris Keller entitled "METHOD FOR FABRICATION OF HIGH VERTICAL ASPECT RATIO THIN FILM STRUCTURES," U.S. Pat. No. 5,645,684 issued to Chris Keller entitled "MULTILAYER HIGH VERTICAL ASPECT RATIO THIN FILM STRUCTURES," as well as the fabrication process disclosed in concurrently filed and commonly assigned U.S. patent application Ser. No. 09/569,330 entitled "METHOD AND SYSTEM FOR SELF-REPLICATING MANUFACTURING STATIONS." However, it should be recognized that the snap connector may be implemented with the snap connector's springs in the same layer, and any such implementation is intended to be within the scope of the present invention. As further shown in FIGS. 11A and 11B, anchors 1199 are preferably implemented in the manner shown to anchor the polysilicon layer 2 to the polysilicon layer 1.

Furthermore, it should be recognized that only a very small insertion force may be required to couple the components using the preloaded snap connector 1100. Basically, the insertion force must be just large enough to release the releasing mechanism 1108. That is, the insertion force must be just great enough to overcome the spring 1102 and the frictional force between the latching mechanisms 1114 and 1116 and their respective retaining mechanisms 1110 and 1112 to enable the releasing mechanism 1108 to be moved along the Y axis as the snap connector 1100 is coupled to the mating component. Most preferably, spring 1102 is relatively weak, thereby reducing the amount of insertion force required to couple the snap connector 1100 to a mating component 1200. In fact, the frictional forces between the latching mechanisms 1114 and 1116 and their respective retaining mechanisms 1110 and 1112 may be greater than the strength of spring 1102, resulting in spring 1102 being negligible in determining the amount of insertion force required for coupling. As shown in FIGS. 11A and 11B, latching mechanisms 1114 and 1116 preferably have a protruding portion (which may also be referred to as a "bulge" or "bump"), shown as 1180 and 1181 respectively. Such protruding portions 1180 and 1181 work to reduce the amount of surface area in contact between the latching mechanisms 1114 and 1116 and their respective retaining mechanisms 1110 and 1112 when the snap connector 1100 is preloaded, thereby reducing the amount of friction and the amount of insertion force required for coupling. Thus, the insertion force required may be dependent on the strength of spring 1102 and the frictional forces between the latching mechanisms 1114 and 1116 and their respective retaining mechanisms 1110 and 1112.

Figure 13A:
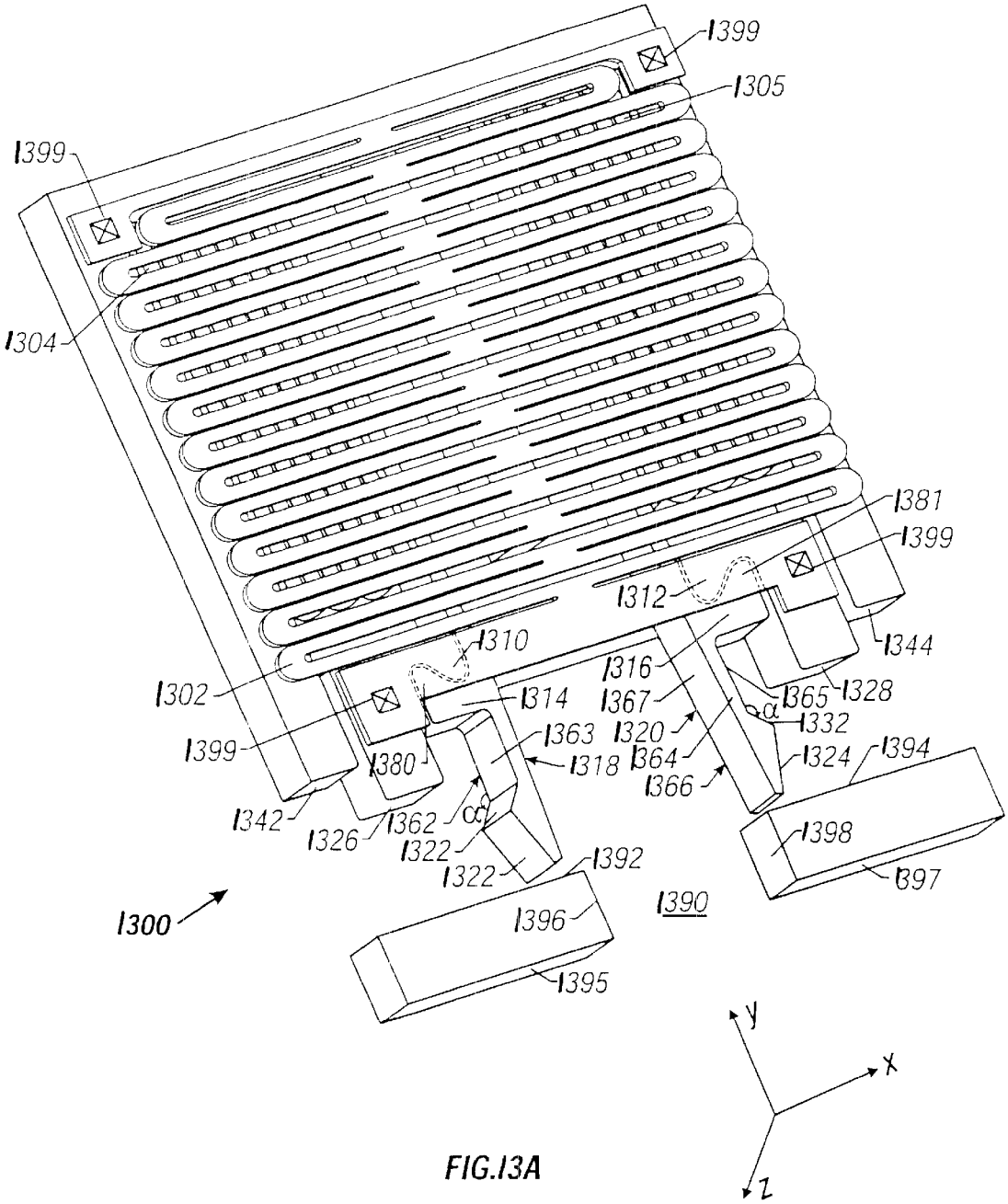
FIG. 13A shows an exemplary implementation of a dual release preloaded snap connector.
Figure 13B:
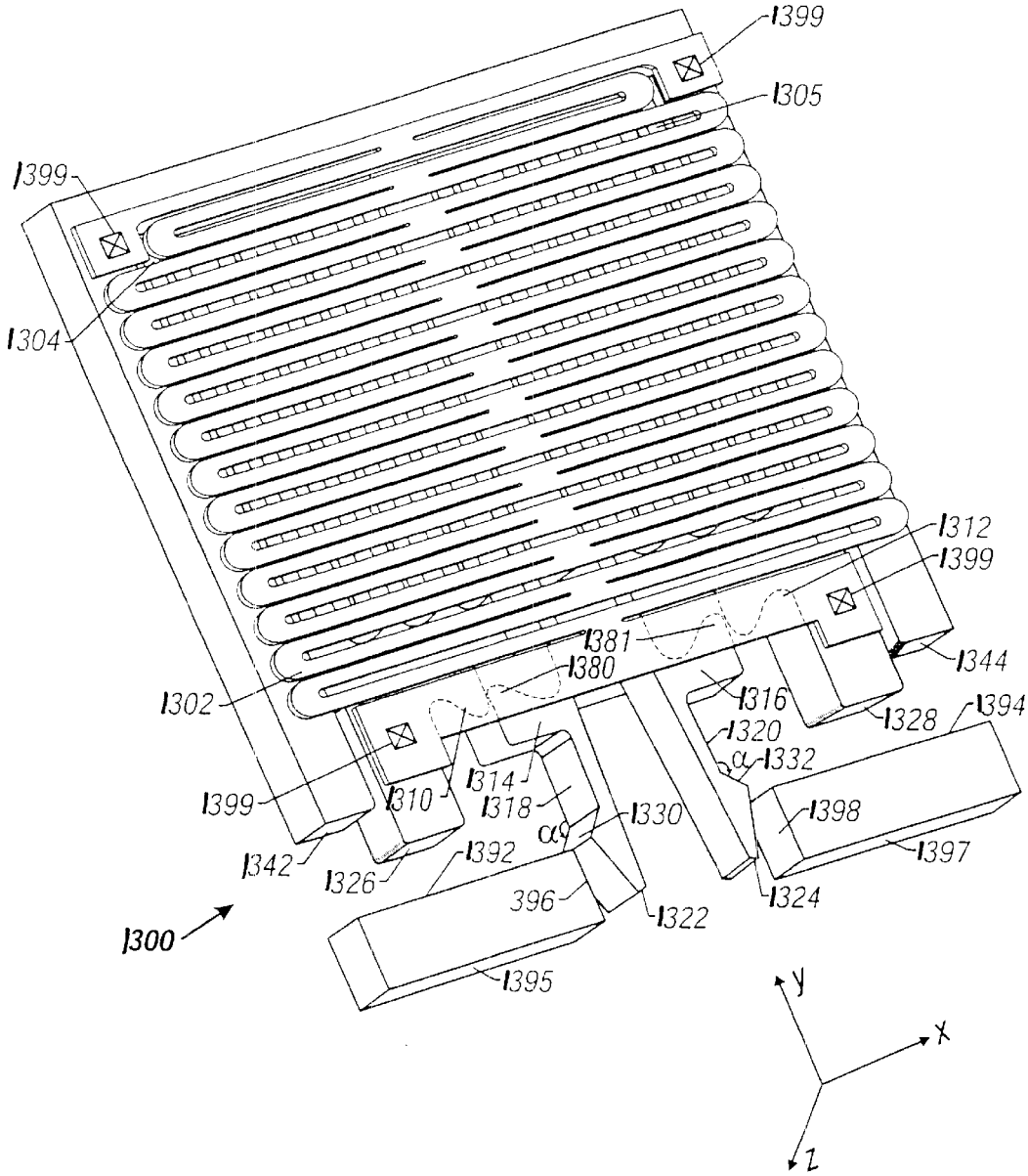
FIG. 13B shows an exemplary implementation of a dual release preloaded snap connector that is "preloaded."
Figure 14:
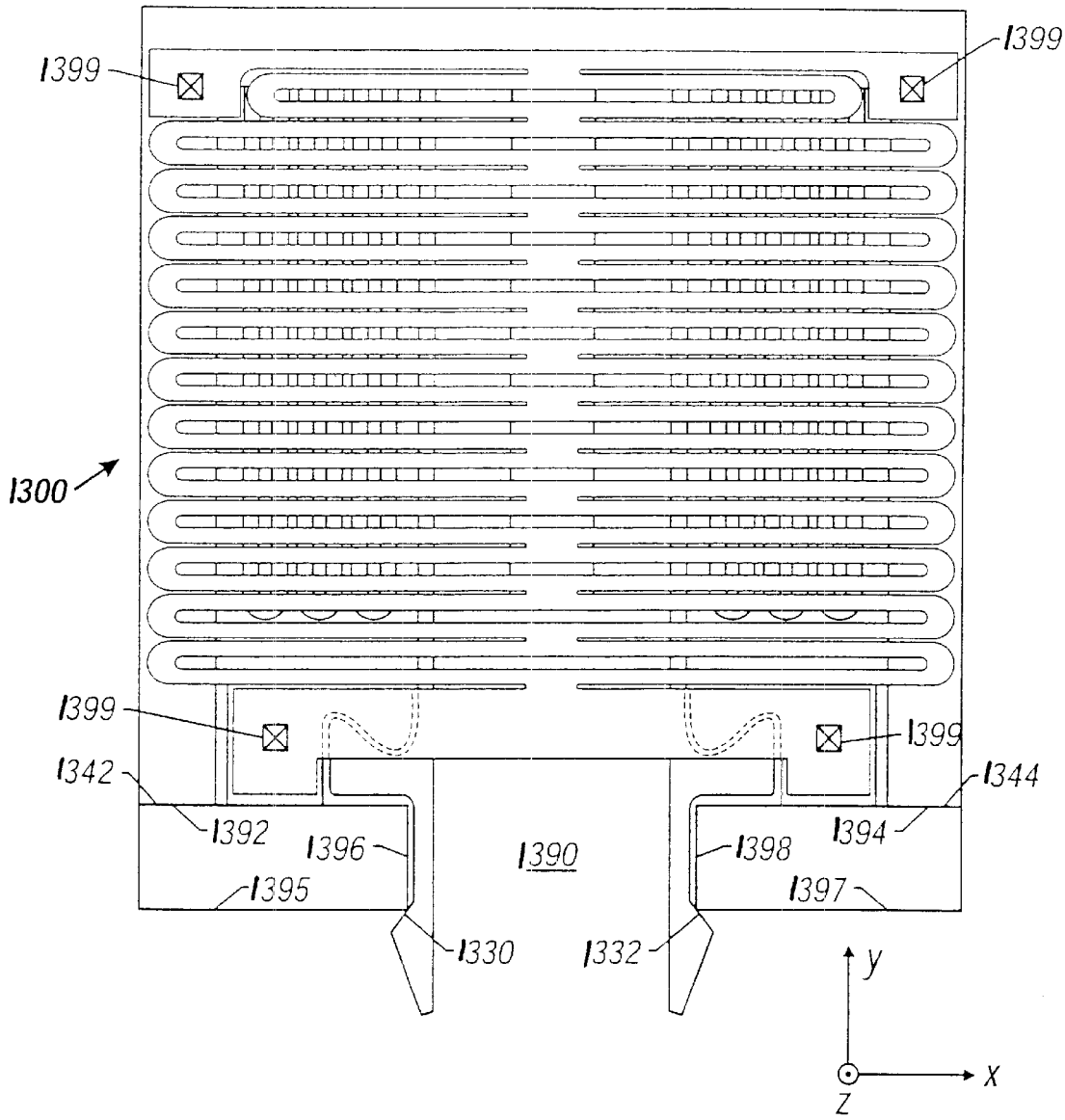
FIG. 14 shows the dual release preloaded snap connector of FIGS. 13A and 13B coupled to a mating component.

Turning now to FIGS. 13A–14, a further exemplary implementation of a preloaded snap connector of a preferred embodiment is illustrated. The exemplary implementation of FIGS. 13A–14 illustrates a dual release preloaded snap connector 1300. The dual release preloaded snap connector 1300 functions much like the single release preloaded snap connector 1100 discussed above in conjunction with FIGS. 11A and 11B. However, rather than utilizing a single release mechanism (e.g., release mechanism 1108 of FIGS. 11A and 11B), the preloaded snap connector 1300 of FIGS. 13A–14 utilizes dual release mechanisms (or "dual triggers") 1326 and 1328. As an example of the operation of dual release preloaded snap connector 1300, one may grip arms 1318 and 1320 and compress them toward each other (e.g., along the X axis of FIGS. 13A and 13B) causing latching members 1314 and 1316 to be moved to a point at which they are held in place by retaining members 1310 and 1312, as shown in FIG. 13B. Thus, the snap connector of FIG. 13B is referred to as being "preloaded." In a most preferred embodiment, such preloaded snap connector 1300 may require approximately 500 microNewton compression force, as an example, to be applied by such a gripper to preload such snap connector 1300. Such preloading may operate much the same as discussed above for FIGS. 11A and 11B. For instance the snap connector 1300 includes three springs, shown as springs 1302, 1304, and 1305. Springs 1304 and 1305 act in the X direction of FIGS. 13A–14, and spring 1302 acts in the Y direction of FIGS. 13A–14. Springs 1302, 1304, and 1305 of snap connector 1300 may operate much as described above for springs 1102, 1104, and 1105 of snap connector 1100 of FIGS. 11A and 11B. More specifically, spring 1304 of snap connector 1300 forms arm 1318 and acts in the X direction of FIG. 13A. Likewise, spring 1305 of snap connector 1300 forms arm 1320 and acts in the X direction of FIG. 13A. Furthermore, spring 1302 of snap connector 1300 is couple to dual release mechanisms 1326 and 1328 such that it acts in the Y direction of FIG. 13A.

As further shown in FIG. 13A, arms 1318 and 1320 include barbed ends which have "insertion sides" 1322 and 1324. As further shown, the barbed ends also include retention sides 1330 and 1332, which may be angled relative to their respective arms to aid in retaining the snap connector coupled to a mating component. That is, retention sides 1330 and 1332 may have an appropriate angle to maintain the snap connector fastened to the mating component in a desirable manner. For example, as shown in FIGS. 13A–14 the retention sides 1130 and 1132 may be at an angle $\alpha$ to their respective arms 1318 and 1320, which may enable the snap connector 1300 be maintained coupled to the mating component. Depending on the coefficient of friction, the angle $\alpha$ that provides the desired amount of "secureness" of the snap connector varies, and any angle $\alpha$ being implemented within the snap connector is intended to be within the scope of the present invention. For instance, a 90 degree angle may be utilized to provide a permanent coupling, while other angles may be implemented for retention sides 1330 and 1332 to enable a temporary/removable (or "disengageable") coupling.

Most preferably, when the snap connector 1300 is preloaded, the barbed ends of snap connector 1300 are positioned to enable relatively easy insertion (e.g., requiring relatively little insertion force) of the barbed ends through aperture(s) of a mating component (e.g., aperture 1390 of a mating component). Most preferably, insertion sides 1322 and 1324 of preloaded snap connector 1300 do not contact the edges of a mating component's apertures during coupling. As a result, if the snap connector is properly aligned respective to a mating component, friction from contact of the snap connector's barbed ends with the edges of the mating component's apertures may be eliminated, thereby reducing the amount of insertion force required to couple the snap connector with the mating component. In a most preferred embodiment, an insertion force of approximately one hundred microNewtons, as an example, may be utilized to successfully couple the preloaded snap connector 1300 with a mating component. As also shown in FIG. 13A, insertion sides 1322 and 1324 may be angled to aid in self-aligning of the snap connector with the mating component, assuming that the snap connector and mating component are misaligned when coupling.

As shown in FIG. 13B, the preloaded snap connector 1300 may be coupled with a mating component by inserting the barbed ends of arms 1318 and 1320 through an aperture of such mating component. As further shown in FIG. 13B, as the arms 1318 and 1320 are inserted into an aperture of a mating component, dual release members 1326 and 1328 engage the surface 1392 and 1394 of the mating component causing the latching members 1314 and 1316 to disengage the retaining members 1310 and 1312. That is, as latching mechanisms 1326 and 1328 are forced upward (due to the insertion force being applied), spring 1302 compresses, thereby moving the retaining members 1310 and 1312 (which are coupled to spring 1102) upward. Thus, when the spring 1302 compresses such that retaining members 1310 and 1312 are moved upward to disengage latching members 1314 and 1316, latching members 1314 and 1316 return outward as springs 1304 and 1305 relax. That is, as the latching members 1314 and 1316 disengage, arms 1318 and 1320 return outward toward their "unloaded" positions (along the X axis of FIGS. 13A–14), resulting in the snap connector 1300 coupling its associated component with the mating component.

More specifically, in a preferred embodiment, arm 1318 applies a force toward side 1396 of the mating component, and arm 1320 applies a force toward side 1398 of the mating component. In a most preferred embodiment, arms 1318 and 1320 each apply a force of approximately one hundred fifty microNewtons to approximately two hundred microNewtons, as an example, toward sides 1396 and 1398, respectively. In a preferred embodiment, front side 1360 of arm 1318 engages an angled side (or wedge side) of the mating component's aperture 1390 (not shown), and back side 1362 of arm 1318 engages the rear side of the component's aperture (not shown), in a manner similar to that shown and described above in conjunction with FIGS. 11A, 11B, and 12. Thus, as described above with the single-release preloaded snap connector 100, sides 1363 and 1361 of arm 1318 and sides 1365 and 1367 of arm 1320 may not actually engage (or contact) sides 1396 and 1398 of aperture 1390 in a preferred embodiment. However, in alternative embodiments, the snap connector's arms and/or the mating component's aperture may be implemented such that the sides of the arms do engage the sides 1396 and 1398 of the aperture.

Additionally, the retaining surfaces 1330 and 1332 of the barbed ends engage the undersides of the mating component, respectively shown as 1395 and 1397 in FIGS. 13A–14, and constrained surfaces 1342 and 1344 of snap connector 1300 engage the upper side of the mating component, shown as 1392 and 1394 in FIGS. 13A–14. In the exemplary implementation of FIGS. 13A–14, the retaining surfaces 1330 and 1332 apply a force against the undersides 1395 and 1397 of the mating component to aid in maintaining the snap connector having a secure connection (e.g., such that the constrained surfaces 1342 and 1344 are maintained flush against the complementary surfaces 1392 and 1394 of the mating component). As a result, the snap connector 1300 works to securely couple its associated component to the mating component.

Turning to FIG. 14, an exemplary illustration of snap connector 1300 coupled to a mating component is shown. As shown, retaining surfaces 1330 and 1332 engage the undersides 1395 and 1397 of the mating component, respectively, to maintain the snap connector coupled to the mating component. As further shown, in a preferred embodiment, the retaining surfaces 1330 and 1332 maintain sufficient force against the undersides 1395 and 1397 such that constrained surfaces 1342 and 1344 of snap connector 1300 remain in flush contact against the complementary surfaces 1392 and 1394 of the mating component.

It should be recognized that such a snap connector 1300 may be utilized for general assembly of microcomponents, just as discussed above for snap connector 1100 of FIGS. 11A and 11B. That is, snap connector 1300 is suitable not only for in-plane, 2-D assembly, but is also suitable for performing out-of-plane, 3-D assembly of microcomponents. When utilized for out-of-plane, 3-D assembly of microcomponents, the snap connector of a preferred embodiment can be utilized to restrict all three degrees of freedom between the coupled components. When utilized for in-plane, 2-D assembly, the snap connector may provide only a reduced restriction of the degrees of freedom between the coupled components (i.e., may restrict only two degrees of freedom). In a preferred embodiment, snap connector 1300 enables out-of-plane, 3-D assembly to be achieved in a manner that enables components to be securely coupled. Thus, a microcomponent may be "picked up" out of the plane of a mating component and securely assembled to such mating component, resulting in a 3-D device. For example, one component on a wafer may be "picked up" off the wafer, rotated such that it is normal to a mating component on such wafer, and then securely coupled to the mating component.

As shown in the exemplary implementation of FIGS. 13A–14, the secure coupling provided between the snap connector 1300 and the mating aperture may restrict all three degrees of linear freedom of the coupled components, respective to each other, as well as restricting rotational degrees of freedom with respect to each other. Accordingly, the snap connector 1300 works to prevent the coupled components from moving linearly with respect to each other to prevent such coupled components from disengaging. More specifically, the snap connector works to prevent one of the coupled components from moving in either the X, Y, or Z directions of FIGS. 13A–14 with respect to the other coupled component. More specifically, the snap connector 1300 and the mating component's aperture 1390 (or "receptacle") work together to prevent such movement in a preferred embodiment. That is, both components may together move in either the X, Y, or Z directions, but the snap connector and mating component aperture work to prevent only one of the coupled components from moving in such directions without the other component also moving in such directions. Furthermore, the snap connector and mating component aperture work to prevent the coupled components from rotating respective to each other. That is, both components may together rotate, but the snap connector, in combination with the mating component aperture, works to prevent only one of the coupled components from rotating without the other component also rotating in a like manner.

It should also be recognized that the snap connector's springs and barbed ends, as well as the aperture of the mating component, may be implemented to aid in allowing the snap connector to be self-positioning or self-centering with the mating component. For example, the inner walls of the mating aperture may be designed to receive the barbed ends of snap connector 1300 (which have insertion sides 1322 and 1324), and aids in self-aligning the snap connector 1300 with a mating component. Additionally, springs 1304 and 1305 also aid in the self-aligning of the snap connector 1300 by enabling the arms 1318 and 1320 some flexibility along the X axis of FIGS. 13A–14. Such self-aligning is a desirable feature to aid in precise assembly of the microcomponents. For example, if positional assembly is being performed with no feedback to the assembly mechanism (i.e., the assembly is dependent on the accurate positioning of the components to be assembled), such self-aligning feature is desirable because it allows for small positional errors to be present for the components to be assembled.

It should also be recognized that just as described above for snap connector 1100 of FIGS. 11A and 11B, the snap connector's springs may be fabricated in separate layers of the snap connector 1300. For instance, springs 1304 and 1305, which operate in the X direction, may be in polysilicon layer 1 of the snap connector, and the spring 1302, which operates in the Y direction, may be in polysilicon layer 2 (thus, overlaying springs 1304 and 1305). As described above, various fabrication processes may be utilized to fabricate a snap connector having springs in different layers. However, it should be recognized that the snap connector 1300 may be implemented with the snap connector's springs in the same layer, and any such implementation is intended to be within the scope of the present invention. As further shown in FIGS. 13A, 13B, and 14, anchors 1399 are preferably implemented in the manner shown to anchor the polysilicon layer 2 to the polysilicon layer 1.

Furthermore, it should be recognized that only a very small insertion force may be required to couple the components using the preloaded snap connector 1300. Basically, the insertion force must be just large enough to release the releasing mechanisms 1326 and 1328. That is, the insertion force must be just great enough to overcome the spring 1302 and the frictional force between the latching mechanisms 1314 and 1316 and their respective retaining mechanisms 1310 and 1312 to enable the releasing mechanisms 1326 and 1328 to be moved along the Y axis as the snap connector 1300 is coupled to the mating component. Most preferably, spring 1302 is relatively weak, thereby reducing the amount of insertion force required to couple the snap connector 1300 to a mating component. In fact, the frictional forces between the latching mechanisms 1314 and 1316 and their respective retaining mechanisms 1310 and 1312 may be greater than the strength of spring 1302, resulting in spring 1302 being negligible in determining the amount of insertion force required for coupling. As shown in FIGS. 13A–14, latching mechanisms 1314 and 1316 preferably have a protruding portion (which may also be referred to as a "bulge" or "bump"), shown as 1380 and 1381 respectively. Such protruding portions 1380 and 1381 work to reduce the amount of surface area in contact between the latching mechanisms 1314 and 1316 and their respective retaining mechanisms 1310 and 1312 when the snap connector 1300 is preloaded, thereby reducing the amount of friction and the amount of insertion force required for coupling. Thus, the insertion force required may be dependent on the strength of spring 1302 and the frictional forces between the latching mechanisms 1314 and 1316 and their respective retaining mechanisms 1310 and 1312.

In view of the exemplary implementations described above, it should be recognized that various other implementations of preloaded snap connectors are possible, and any such implementations are intended to be within the scope of the present invention. Thus, the present invention is not intended to be limited only to the implementations of a preloaded snap connector provided herein, rather such implementations are intended solely as examples that render the disclosure enabling for many other implementations of a preloaded snap connector. For example, the latching mechanism(s) and release mechanism(s) of a preloaded snap connector may be implemented in any number of ways within the snap connector, and any such implementation is intended to be within the scope of the present invention. For instance, the springs of the preloaded snap connectors disclosed above may be implemented within a common layer, rather than in separate layers, as described above.

Figure 5:
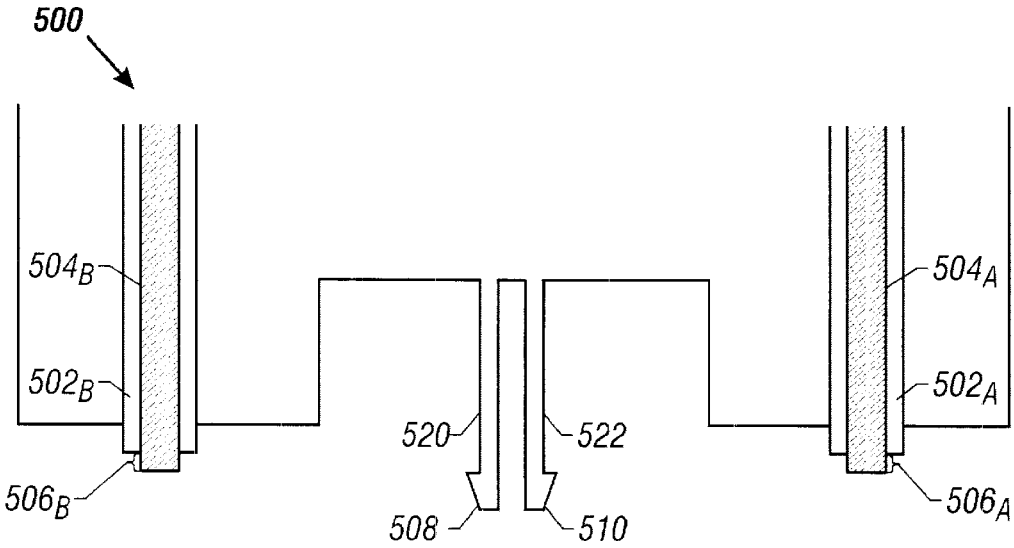
FIG. 5 shows an exemplary implementation of a preferred embodiment of an electrical connector.

Turning to FIG. 5, an exemplary implementation of an electrical snap connector 500 is shown. Electrical snap connector 500 may be utilized to electrically couple a ribbon cable, as disclosed herein, to one or more microcomponents. Alternatively, the electrical snap connector 500 may be utilized to provide a direct electrical coupling between two microcomponents. For example, electrical snap connector 500 may be integrated within a first microcomponent, and it may be utilized to electrically couple such first microcomponent to a second microcomponent.

The exemplary electrical snap connector 500 includes barbed ends 508 and 510 for coupling with a mating microcomponent. An example of such coupling of a snap connector with a mating component is more fully disclosed in "SYSTEM AND METHOD FOR COUPLING MICROCOMPONENTS." As shown in FIG. 5, the electrical snap connector 500 further includes conducting material $\mathbf{504}_A$ (e.g., gold), which may be a portion of the conducting material of a ribbon cable row. The electrical snap connector 500 further includes conducting material $\mathbf{504}_B$, which may be electrically isolated from the conducting material $\mathbf{504}_A$. For example, the electrical conducting material $\mathbf{504}_A$ may be a portion of the conducting material 102 of row 201 shown in FIG. 2, and the electrical conducting material $\mathbf{504}_B$ may be a portion of the conducting material 102 of row 202 shown in FIG. 2. In the exemplary implementation of FIG. 5, the electrical snap connector 500 further includes a supporting polysilicon layer (e.g., poly 2 layer) for each conducting material $\mathbf{504}_A$ and $\mathbf{504}_B$, respectively shown as supporting layers $\mathbf{502}_A$ and $\mathbf{502}_B$. Furthermore, in the exemplary implementation of FIG. 5, each conducting material $\mathbf{504}_A$ and $\mathbf{504}_B$ "overhang" their respective supporting layers $\mathbf{502}_A$ and $\mathbf{502}_B$. For example, overhang portions $\mathbf{506}_A$ and $\mathbf{506}_B$ (which may also be referred to as the snap connector's "electrodes") are included within the exemplary electrical snap connector 500, which are utilized in forming an electrical coupling with a mating component.

Figure 6:
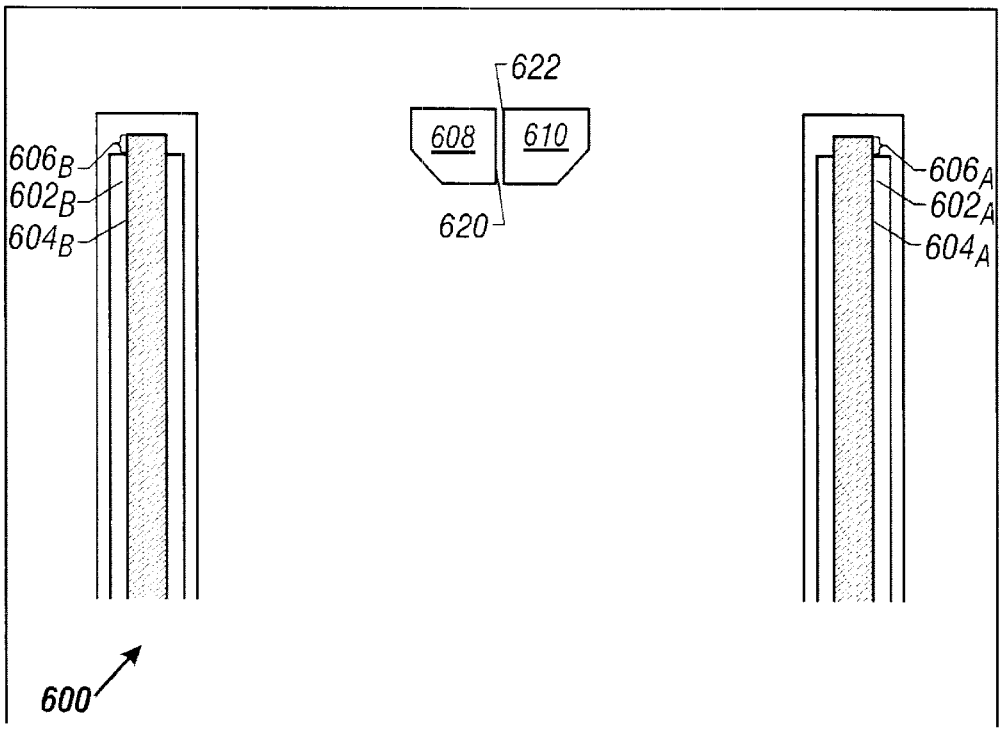
FIG. 6 shows an exemplary implementation of a mating component that may be electrically coupled to the exemplary electrical connector of FIG. 5.

Turning now to FIG. 6, an exemplary implementation of a mating component 600 that may be electrically coupled to the electrical snap connector 500 of FIG. 5 is shown. For example, the electrical snap connector 500 may be utilized to electrically couple a ribbon cable, as disclosed herein, to the mating component 600 of FIG. 6. Alternatively, the electrical snap connector 500 may be utilized to provide a direct electrical coupling between a microcomponent with which it is integrated and the mating component 600 of FIG. 6. As shown in FIG. 6, the mating component 600 includes apertures 608 and 610 for receiving the barbed ends 508 and 510 of the electrical snap connector 500. An example of coupling a snap connector with a mating component in this manner is more fully disclosed in "SYSTEM AND METHOD FOR COUPLING MICROCOMPONENTS." It should be recognized that as disclosed in "SYSTEM AND METHOD FOR COUPLING MICROCOMPONENTS" the snap connector 500 may provide a coupling mechanism suitable for coupling with the mating component 600 either in-plane or out-of-plane, and any such coupling is intended to be within the scope of the present invention.

As shown in FIG. 6, the mating component 600 further includes conducting material $\mathbf{604}_A$ (e.g., gold), which is utilized to conduct electrical signals for the mating component 600. The mating component 600 further includes conducting material $\mathbf{604}_B$, which may be electrically isolated from the conducting material $\mathbf{604}_A$. For example, the electrical conducting material $\mathbf{604}_A$ may be capable of receiving a first electrical signal via an electrical coupling with the electrical snap connector 500, and the electrical conducting material $\mathbf{604}_B$ may be capable of receiving a second electrical signal (electrically isolated from the first electrical signal) via an electrical coupling with the electrical snap connector 500. In the exemplary implementation of FIG. 6, the mating component 600 further includes a supporting polysilicon layer (e.g., poly 2 layer) for each conducting material $\mathbf{604}_A$ and $\mathbf{604}_B$, respectively shown as supporting layers $\mathbf{602}_A$ and $\mathbf{602}_B$. Furthermore, in the exemplary implementation of FIG. 6, each conducting material $\mathbf{604}_A$ and $\mathbf{604}_B$ "overhang" their respective supporting layers $\mathbf{602}_A$ and $\mathbf{602}_B$. For example, overhang portions $\mathbf{606}_A$ and $\mathbf{606}_B$ (which may also be referred to as the mating component's "electrodes") are included within the exemplary mating component 600, which are utilized in forming an electrical coupling with the electrical snap connector 500.

In operation, the exemplary electrical snap connector 500 is coupled to the mating component 600 by having its barbed ends 508 and 510 inserted into apertures 608 and 610 of the mating component 600. Preferably, the electrical snap connector 500 forms a secure coupling with the mating component 600. It should be understood that the snap connector 500 may be implemented to form a permanent coupling with the mating component 600, or the snap connector 500 may be implemented to form a temporary (or removable) coupling with the mating component 600. The scope of the present invention is intended to encompass any type of coupling formed between such a connector and mating component. As the electrical snap connector 500 and mating component 600 are joined, the conducting material of each are brought into contact with one another to form an electrical coupling. That is, as the electrical snap connector 500 and mating component 600 are connected, the conducting material of each are aligned in a desired manner to achieve an electrical coupling between the components. For example, the conductive material $\mathbf{504}_A$ of snap connector 500 may be brought into contact with the conductive material $\mathbf{604}_A$ of mating component 600. Accordingly, electrical signals may be communicated between the electrically coupled components via the joined conductive materials $\mathbf{504}_A/\mathbf{604}_A$. Likewise, the conductive material $\mathbf{504}_B$ of snap connector 500 may be brought into contact with the conductive material $\mathbf{604}_B$ of mating component 600. Accordingly, electrical signals may be communicated between the electrically coupled components via the joined conductive materials $\mathbf{504}_B/\mathbf{604}_B$.

In a most preferred embodiment, the mating component's electrodes $\mathbf{606}_A$ and $\mathbf{606}_B$ rare flexible, such that they bend downward when the electrical snap connector 500 is coupled to the mating component 600. More specifically, as the electrical snap connector 500is coupled with the mating component 600, the snap connector's electrodes $\mathbf{506}_A$ and $\mathbf{506}_B$ engage the mating component's electrodes $\mathbf{606}_A$ and $\mathbf{606}_B$ exerting a downward force thereon, thereby causing the mating component's electrodes $\mathbf{606}_A$ and $\mathbf{606}_B$ to bend downward. Such an implementation may aid in maintaining a continuous electrical coupling between the engaged electrodes. That is, once the mating component's electrodes are bent downward, they maintain an upward force against the snap connector's electrodes by attempting to return upward to their biased position, thereby aiding in maintaining an uninterrupted electrical connection.

Although two electrical conducting materials are shown as implemented within the snap connector 500 (i.e., conducting materials $\mathbf{504}_A$ and $\mathbf{504}_B$) and within the mating component 600 (i.e., conducting materials $\mathbf{604}_A$ and $\mathbf{604}_B$), it should be understood that any number of such conducting materials may be included within the electrical connector and/or the mating component in various implementations, and any such implementations are intended to be within the scope of the present invention. For example, any number of electrically isolated conducting materials (i.e., one or more) may be implemented within the electrical connector and/or the mating component, and any such implementation is intended to be within the scope of the present invention.

Figure 7A:
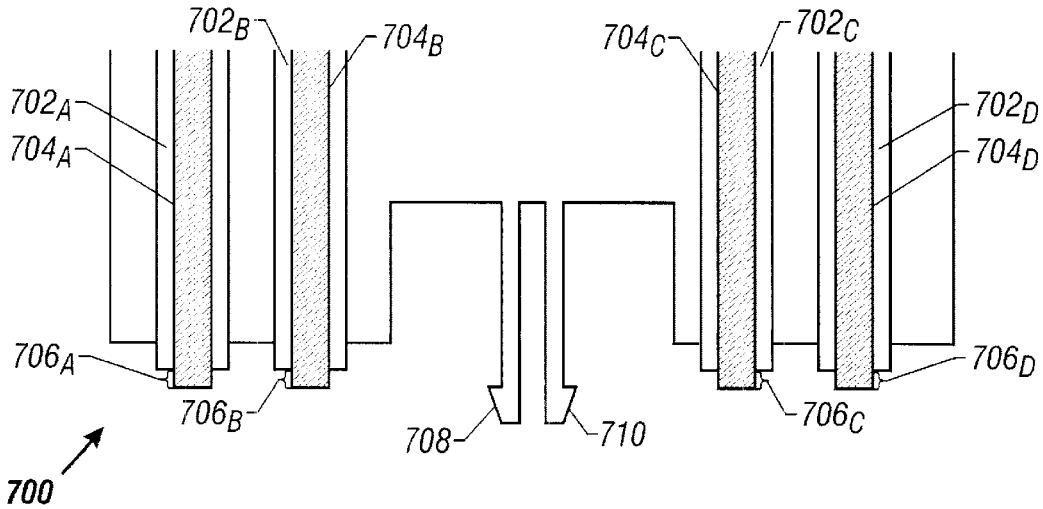
FIG. 7A shows another exemplary implementation of an electrical connector, which comprises four electrically isolated conducting materials.
Figure 7B:
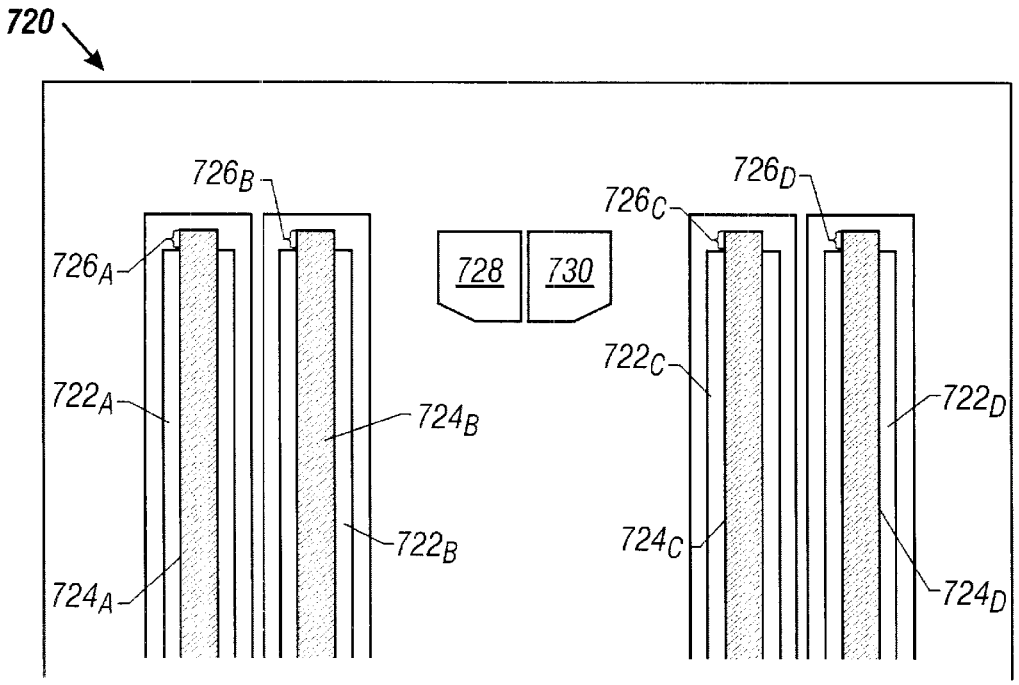
FIG. 7B shows an exemplary implementation of a mating component that may be electrically coupled to the exemplary electrical connector of FIG. 7A.

Turning to FIGS. 7A and 7B, an exemplary implementation of an electrical snap connector 700 and mating component 720 that each have four electrically isolated conducting materials is provided. The electrical snap connector 700 of FIG. 7A may be utilized to electrically couple a ribbon cable, as disclosed herein, to one or more microcomponents (e.g., by coupling barbed ends 708 and 710 through the mating component's apertures 728 and 730). For example, a ribbon cable having four electrically isolated conducting rows may include snap connector 700 on one or both ends to electrically couple the ribbon cable to a mating component. For instance, each isolated conducting row of the ribbon cable may correspond with a separate one of the four conducting materials $\mathbf{704}_A$, $\mathbf{704}_B$, $\mathbf{704}_C$, and $\mathbf{704}_D$ of snap connector 700. That is, each isolated conducting row of the ribbon cable may be electrically coupled to a separate one of the four conducting materials $\mathbf{704}_A$, $\mathbf{704}_B$, $\mathbf{704}_C$, and $\mathbf{704}_D$ of snap connector 700. As an example, the ribbon cable may be fabricated having snap connector 700 on one or both of its ends, such that the conducting material within each of the conducting rows of the ribbon cable extends through the associated snap connector 700, i.e., the conducting material of a conducting row of the ribbon cable extends to the snap connector 700 to also serve as the conducting material of the snap connector 700. Alternatively, the snap connector 700 may couple in some manner to the ribbon cable such that an electrical coupling is formed therebetween (e.g., each of the conducting rows of the ribbon cable engage a separate one of the conducting materials of the snap connector 700). For instance, the electrical snap connector 700 may be a "dual connector" as described in "SYSTEM AND METHOD FOR COUPLING MICROCOMPONENTS," such that it can form a connection with a ribbon cable and also form a connection with a mating component, thereby electrically coupling the ribbon cable to the mating component. Of course, the electrical snap connector 700 may be utilized in situations without a ribbon cable, such as to provide a direct electrical coupling between two microcomponents. For example, electrical snap connector 700 may be integrated within a first microcomponent, and it may be utilized to electrically couple such first microcomponent to a second microcomponent.

As shown in FIG. 7, the electrical snap connector 700 includes conducting material $\mathbf{704}_A$ (e.g., gold), which may be a portion of the conducting material of a ribbon cable row. The electrical snap connector 700 further includes conducting material $\mathbf{704}_B$, $\mathbf{704}_C$, and $\mathbf{704}_D$, which may each be electrically isolated. For example, each of the electrical conducting materials $\mathbf{704}_A$, $\mathbf{704}_B$, $\mathbf{704}_C$, and $\mathbf{704}_D$ may correspond to a separate conducting row of a ribbon cable to which the electrical snap connector 700 is coupled. In the exemplary implementation of FIG. 7, the electrical snap connector 700 further includes a supporting polysilicon layer (e.g., poly 2 layer) for each conducting material $\mathbf{704}_A$, $\mathbf{704}_B$, $\mathbf{704}_C$, and $\mathbf{704}_D$, respectively shown as supporting layers $\mathbf{702}_A$, $\mathbf{702}_B$, $\mathbf{702}_C$, and $\mathbf{702}_D$. Furthermore, in the exemplary implementation of FIG. 7, each conducting material $\mathbf{704}_A$, $\mathbf{704}_B$, $\mathbf{704}_C$, and $\mathbf{704}_D$ "overhang" their respective supporting layers $\mathbf{702}_A$, $\mathbf{702}_B$, $\mathbf{702}_C$, and $\mathbf{702}_D$. For example, overhang portions $\mathbf{706}_A$, $\mathbf{706}_B$, $\mathbf{706}_C$, and $\mathbf{706}_D$ (which may also be referred to as the snap connector's "electrodes") are included within the exemplary electrical snap connector 700, which are utilized in forming an electrical coupling with a mating component in a similar manner as described above in conjunction with FIGS. 5 and 6.

Turning now to FIG. 7B, an exemplary implementation of a mating component 720 that may be electrically coupled to the electrical snap connector 700 of FIG. 7A is shown. For example, the electrical snap connector 700 may be utilized to electrically couple a ribbon cable, as disclosed herein, to the mating component 720 of FIG. 7B. Alternatively, the electrical snap connector 700 may be utilized to provide a direct electrical coupling between a microcomponent with which it is integrated and the mating component 720 of FIG. 7B. As shown in FIG. 7B, the mating component 720 includes apertures 728 and 730 for receiving the barbed ends 708 and 710 of the electrical snap connector 700. An example of coupling a connector with a mating component in this manner is more fully disclosed in "SYSTEM AND METHOD FOR COUPLING MICROCOMPONENTS." It should be recognized that as disclosed in "SYSTEM AND METHOD FOR COUPLING MICROCOMPONENTS" the snap connector 700 may provide a coupling mechanism suitable for coupling with the mating component 720 either in-plane or out-of-plane, and any such coupling is intended to be within the scope of the present invention.

As shown in FIG. 7B, the mating component 720 further includes conducting material $\mathbf{724}_A$ (e.g., gold), which is utilized to conduct electrical signals for the mating component 720. The mating component 720 further includes conducting materials $\mathbf{724}_B$, $\mathbf{724}_C$, and $\mathbf{724}_D$, which may each be electrically isolated. For example, the electrical conducting materials $\mathbf{724}_A$, $\mathbf{724}_B$, $\mathbf{724}_C$, and $\mathbf{724}_D$ may each be capable of receiving a separate electrical signal via an electrical coupling with the electrical snap connector 700. In the exemplary implementation of FIG. 7B, the mating component 720 further includes a supporting polysilicon layer (e.g., poly 2 layer) for each conducting material $\mathbf{724}_A$, $\mathbf{724}_B$, $\mathbf{724}_C$, and $\mathbf{724}_D$, respectively shown as supporting layers $\mathbf{722}_A$, $\mathbf{722}_B$, $\mathbf{722}_C$, and $\mathbf{722}_D$. Furthermore, in the exemplary implementation of FIG. 7B, each conducting material $\mathbf{724}_A$, $\mathbf{724}_B$, $\mathbf{724}_C$, and $\mathbf{724}_D$ "overhang" their respective supporting layers $\mathbf{722}_A$, $\mathbf{722}_B$, $\mathbf{722}_C$, and $\mathbf{722}_D$. For example, overhang portions $\mathbf{726}_A$, $\mathbf{726}_B$, $\mathbf{726}_C$, and $\mathbf{726}_D$ (which may also be referred to as the mating component's "electrodes") are included within the exemplary mating component 720, which are utilized in forming an electrical coupling with the electrical snap connector 700.

In operation, the exemplary electrical snap connector 700 is coupled to the mating component 720 by having its barbed ends 708 and 710 inserted into apertures 728 and 730 of the mating component 720 in a manner similar to that described above in conjunction with FIGS. 5 and 6. Preferably, the electrical snap connector 700 forms a secure coupling with the mating component 720. It should be understood that the snap connector 700 may be implemented to form a permanent coupling with the mating component 720, or the snap connector 700 may be implemented to form a temporary (or removable) coupling with the mating component 720. The scope of the present invention is intended to encompass any type of coupling formed between such a connector and mating component. As the electrical snap connector 700 and mating component 720 are joined, the conducting material of each are brought into contact with one another to form an electrical coupling. That is, as the electrical snap connector 700 and mating component 720 are connected, the conducting material of each are aligned in a desired manner to achieve an electrical coupling between the components. For example, the conductive material $\mathbf{704}_A$ of snap connector 700 may be brought into contact with the conductive material $\mathbf{724}_A$ of mating component 720, the conductive material $\mathbf{704}_B$ of snap connector 700 may be brought into contact with the conductive material $\mathbf{724}_B$ of mating component 720, and so on. Accordingly, electrical signals may be communicated between the electrically coupled components via the joined conductive materials $\mathbf{704}_A/\mathbf{724}_A$, $\mathbf{704}_B/\mathbf{724}_B$, $\mathbf{704}_C/\mathbf{724}_C$, and $\mathbf{704}_D/\mathbf{724}_D$.

It should be understood that the present invention is not intended to be limited only to the electrical snap connector implementations described herein, but rather any type of connector may be implemented as an electrical connector, including but not limited to the connector embodiments disclosed in "SYSTEM AND METHOD FOR COUPLING MICROCOMPONENTS." Additionally, the present invention is not intended to be limited only to the mating connector implementations (e.g., apertures) described herein, but rather any type of mating aperture may be implemented. Furthermore, the electrical conducting materials may be implemented in any manner within the electrical connector and/or the mating component, and any such implementation is intended to be within the scope of the present invention. For example, in one exemplary implementation, conducting materials may be provided along the connector's "arms," such as arms 520 and 522 of snap connector 500 shown in FIG. 5. Likewise, conducting materials may be provided along the edges of the mating component's apertures, such as the edges 620 and 622 of apertures 608 and 610 of the mating component 600 shown in FIG. 6. Accordingly, in such an exemplary embodiment, the conducting materials included on the arms 520 and 522 of snap connector 500 may be implemented to engage the conducting materials provided along the edges 620 and 622 of the apertures of the mating component 600 when the snap connector 500 is coupled to the mating component 600, thereby achieving an electrical coupling between the connector and the mating component. Of course, the electrical conducting materials may be implemented in any number of other ways within the connector and/or the mating component, and any such implementation is intended to be within the scope of the present invention.

Figure 8:
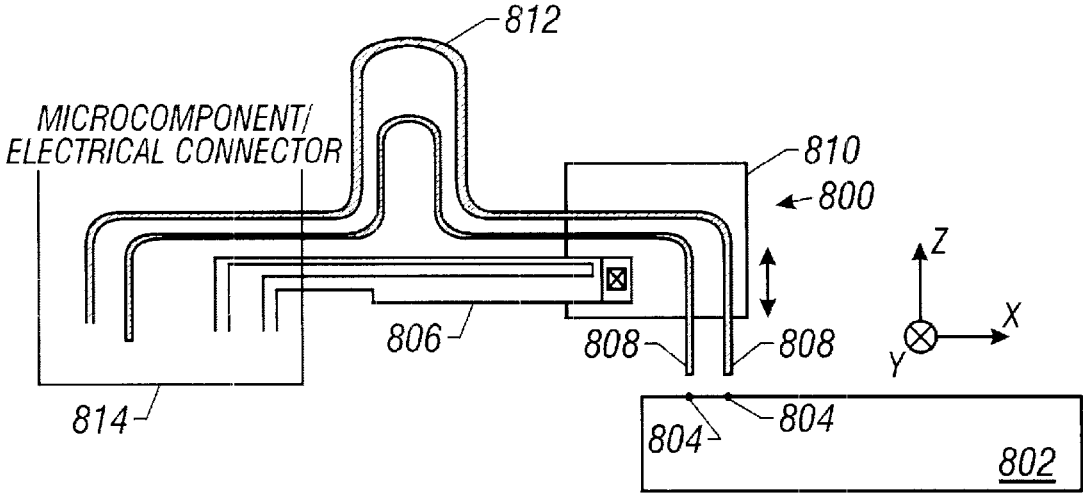
FIG. 8 shows an exemplary implementation of a Z clamp electrical connector that enables an engageable/disengageable electrical coupling to be achieved between two or more microcomponents to allow for an unobtrusive electrical coupling.

As described above, a preferred embodiment provides a ribbon cable that enables a flexible electrical coupling between two or more microcomponents. Accordingly, the ribbon cable provides a somewhat unobtrusive means for electrically coupling microcomponents in that the ribbon cable is flexible to allow the coupled components to move in relation to each other. Turning now to FIG. 8, an electrical connector is disclosed that further enables an unobtrusive electrical coupling to be achieved between two or more microcomponents. The electrical connector implementation of FIG. 8 may be referred to as a "Z clamp" connector. As will be described in greater detail hereafter, the Z clamp implementation of FIG. 8 provides the ability to achieve an unobtrusive electrical connection to a microcomponent that is movable relative to another microcomponent, by enabling an engageable/disengageable electrical connection.

FIG. 8 shows a side view of an exemplary implementation of a Z clamp 800 that may be implemented to provide an unobtrusive electrical connection for a moveable component. As shown in the exemplary implementation of FIG. 8, a movable component 802 may be provided, and it may be desirable to achieve an unobtrusive electrical connection with the movable component 802. For example, component 802 may be a rotator (as described hereafter in conjunction with FIG. 9) or any other type of movable component with which it is desirable to achieve an electrical coupling. Included on the movable component 802 is one or more conducting materials 804 (e.g., gold). Of course, the movable component 802 may also include a supporting layer beneath the conducting materials 804, such as a poly 2 layer (similar to the supporting layers $\mathbf{602}_A$ and $\mathbf{602}_B$ included in the mating component 600 of FIG. 6).

Also shown in FIG. 8 is a Z clamp 800, which includes one or more conducting materials 808 (e.g., gold). Of course, the Z clamp may further include a supporting layer 807 beneath the conducting materials 808, such as a poly 2 layer (similar to the supporting layers $\mathbf{502}_A$ and $\mathbf{502}_B$ included in the snap connector 500 of FIG. 5). The Z clamp 800 may be fabricated to further include a poly 1 layer, insulating layer (e.g., nitride layer), and a mold rib, collectively shown as 810 in FIG. 8, which are similar to the layers described in conjunction with the exemplary ribbon cable implementation of FIGS. 1 and 2. An actuator 806 is also coupled to the Z clamp 800, which is preferably a thermal actuator. Most preferably, the actuator 806 is implemented such that it moves upward (e.g., out of the plane of the moveable component 802 or along the "Z" axis of FIG. 8) when activated. In operation, when the actuator 806 is activated, it lifts the Z clamp 800 from the movable component 802, thereby breaking the electrical connection between the Z clamp 800 and the movable component 802 (i.e., disengaging the Z clamp and the component). When the actuator 806 is not activated, it relaxes, allowing the actuator 806 to return downward to a position in which the conducting materials 808 of the Z clamp engage the conducting materials 804 of the movable component 802, thereby forming an electrical connection between the Z clamp 800 and movable component 802 (i.e., engaging the Z clamp and the component).

As further shown in FIG. 8, the conducting materials 808 of the Z clamp 800 extend to a microcomponent or electrical connector 814. For example, the Z clamp 800 may be integrated with (e.g., fabricated as part of) a microcomponent 814 to enable the microcomponent 814 to obtain an electrical connection with a movable component 802. As a further example, the Z clamp 800 may include an electrical connector, such as an electrical snap connector, to enable the Z clamp 800 to be coupled to another microcomponent to enable an electrical coupling between such microcomponent and the movable component 802. For instance, the Z clamp 800 may be coupled directly to a microcomponent via a connector 814, or the Z clamp 800 may be coupled to a microcomponent via a ribbon cable.

Preferably, the Z clamp 800 is flexibly coupled to the microcomponent/electrical connector 814 in a manner that enables the Z clamp 800 to be moved upward/downward in relation to the surface of the movable component 802, according to the actuator 806. Thus, for example, the conducting material 808 may bend, as shown by 812 in FIG. 8, to allow the Z clamp to be moved upward/downward. Various techniques may be implemented to achieve such a flexible coupling between the Z clamp 800 and the microcomponent/electrical connector 814. An example of one technique that may be utilized is to implement the conducting material 808 and its supporting layer (e.g., poly 2 layer) such that they are sufficiently flexible for the Z clamp's operation. Another exemplary technique that may be utilized is to implement an area between the Z clamp 800 and the microcomponent/electrical connector 814 that is only the conducting material 808 (e.g., with no supporting layer) in order to allow sufficient flexibility for the Z clamp 800 to function. For instance, as described for the exemplary ribbon cable implementation of FIG. 4A, the Z clamp 800 may be coupled to the microcomponent/electrical connector 814 utilizing a "segmented" conducting material 808, in which some segments of the conducting material 808 include a supporting layer and other segments do not include a supporting layer in order to increase the flexibility of such coupling.

Most preferably, the Z clamp 800 is implemented such that it engages the movable component 802 (to form an electrical coupling) when the actuator 806 is powered off (i.e., utilizes "power off engagement"), and the Z clamp 800 disengages the movable component 802 (breaks the electrical coupling) when the actuator 806 is powered on. Of course, the Z clamp could alternatively be implemented to engage upon power-on of the actuator 806 and disengage upon power-off of the actuator 806, and any such implementation is intended to be within the scope of the present invention.

Figure 9:
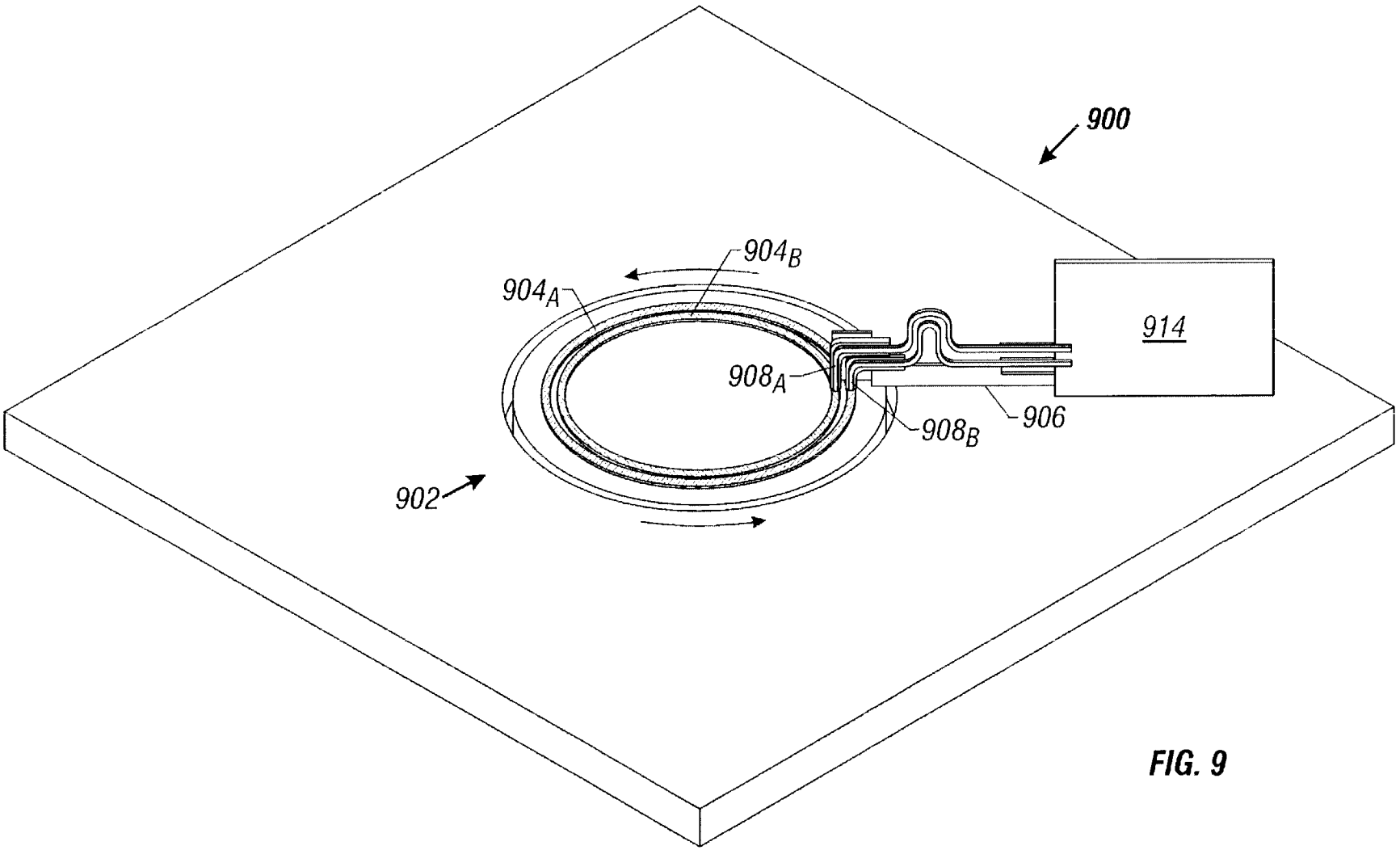
FIG. 9 shows an exemplary implementation wherein a Z clamp electrical connector of FIG. 8 enables an engageable/disengageable electrical coupled to be achieved with a rotator.
Figure 10:
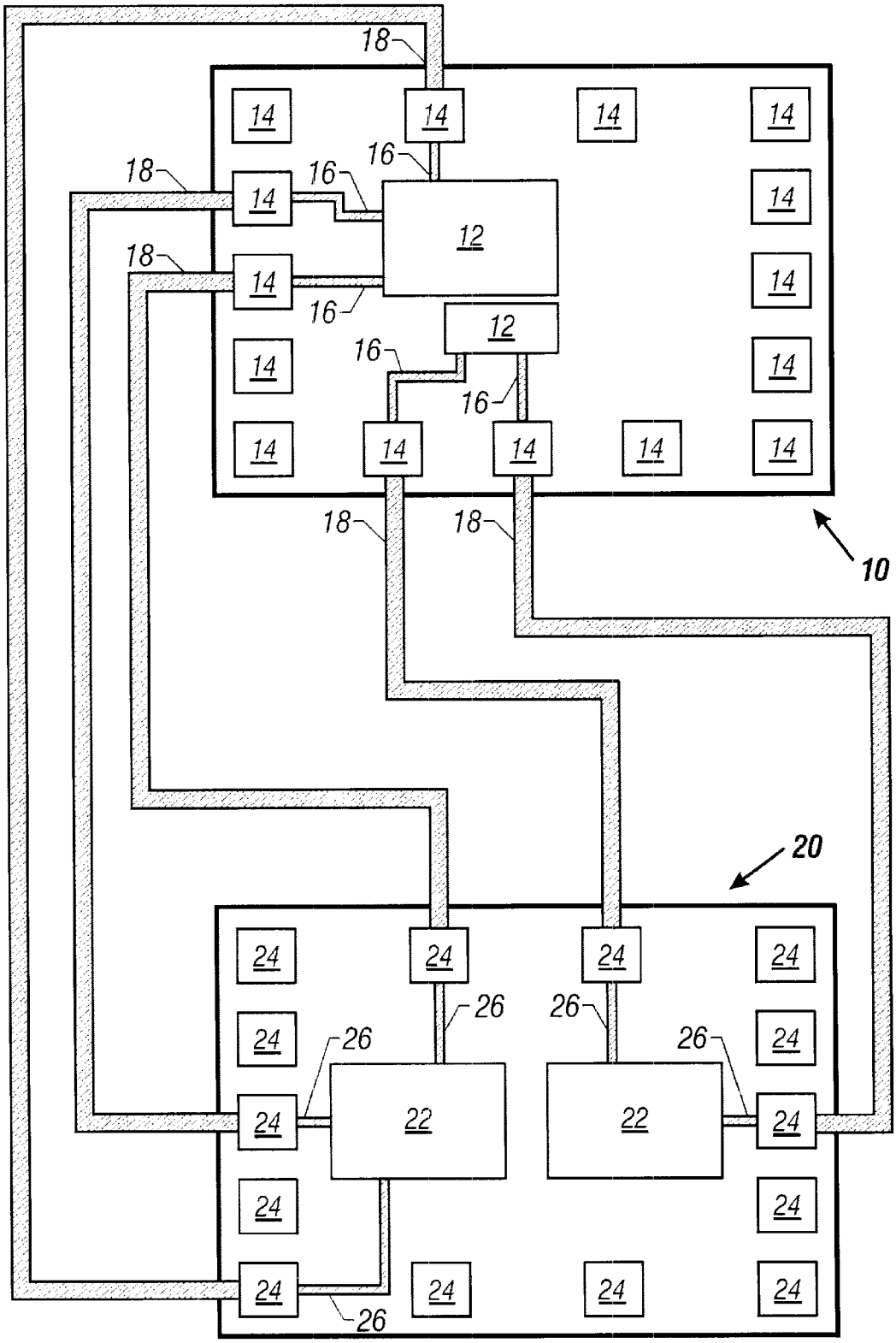
FIG. 10 (Prior Art)
FIG. 10 shows an exemplary prior art implementation for electrically coupling microcomponents.

Turning now to FIG. 9, an exemplary implementation is shown to further illustrate the operation of a Z clamp electrical connector. Shown in FIG. 9 is an exemplary Z clamp 900 that includes conducting materials $\mathbf{908}_A$ and $\mathbf{908}_B$, which is coupled to microcomponent/electrical connector 914. Actuator 906 is further included, which is operable to lower/raise the Z clamp 900 to enable the conducting materials $\mathbf{908}_A$ and $\mathbf{908}_B$ to engage/disengage a movable component. An exemplary rotator 902 is also shown as one type of movable component with which the Z clamp 900 may form an unobtrusive electrical connection. The exemplary rotator 902 includes conducting materials $\mathbf{904}_A$ and $\mathbf{904}_B$, which are engaged by conducting materials $\mathbf{908}_A$ and $\mathbf{908}_B$, respectively, when the Z clamp 900 is lowered to engage the rotator 902. Accordingly, an electrical coupling is achieved between the Z clamp 900 and the rotator 902 via their respective conducting materials being engaged, when the Z clamp 900 is positioned to engage the rotator 902. In operation, the actuator 906 may be activated to lift the Z clamp 900 to disengage the Z clamp 900 from the rotator 902, thereby breaking the electrical connection therebetween. Thereafter, the rotator 902 may rotate to a desired position. Once the rotator 902 is in a desired position, the actuator 906 may be deactivated allowing the Z clamp 900 to lower to engage the rotator 902, thereby again forming an electrical coupling therebetween.

In view of the above, the Z clamp 900 may be utilized to achieve an unobtrusive electrical coupling that may not be as easily achieved through other electrical coupling mechanisms. For example, the hard-wiring technique commonly utilized in the prior art would be inappropriate because having a component hard-wired to the rotator 902 would obstruct the rotator 902 from rotating as desired. Furthermore, utilizing a flexible ribbon cable to form such an electrical coupling between a component and the rotator 902 may present a limitation as to the amount of movement (e.g., rotating) that may be performed by the rotator 902. For example, the ribbon cable may limit the number of rotations that the rotator 902 can make in one direction without damaging the ribbon cable. Thus, a Z clamp implementation may be utilized to enable a desirable unobtrusive electrical connection between microcomponents that are movable relative to each other. For instance, the exemplary Z clamp 900 enables the rotator 902 to rotate an unlimited number of times, while providing the ability of a microcomponent/electrical connector 914 to achieve electrical connections with the rotator 902. Additionally, the exemplary Z clamp 900 is implemented as to not obstruct the rotation of the rotator 902. For example, the Z clamp 900 can be lifted off of the surface of the rotator 902 (i.e., disengage rotator 902) during its rotating operation, rather than requiring the conducting materials of the Z clamp 900 and the rotator 902 to be in contact such that they rub together as the rotator 902 rotates.

It should be recognized that the electrical coupling mechanisms disclosed herein, including ribbon cables, electrical connectors, and Z clamp connectors, may be fabricated utilizing the process disclosed in concurrently filed and commonly assigned U.S. patent application Ser. No. 09/569,330 entitled "METHOD AND SYSTEM FOR SELF-REPLICATING MANUFACTURING STATIONS." However, it should be understood that other fabrication processes may be utilized, and the scope of the present invention is intended to encompass electrical coupling mechanisms for use with microcomponents, as disclosed herein, irrespective of the fabrication process utilized to develop such mechanisms. Recent developments have allowed for fabrication of releasable microcomponents (e.g., stand-alone microcomponents that may be released from the die site). For example, the fabrication process disclosed in "METHOD AND SYSTEM FOR SELF-REPLICATING MANUFACTURING STATIONS" allows for fabrication of releasable microcomponents. Furthermore, the fabrication process disclosed in "METHOD AND SYSTEM FOR SELF-REPLICATING MANUFACTURING STATIONS" also allows for the fabrication of electrically isolated microcomponents. Additionally, other fabrication processes may be developed in the future to also allow for releasable microcomponents. It should be recognized that the electrical coupling mechanisms disclosed herein are suitable for coupling such releasable, stand-alone microcomponents.

Releasable microcomponents may in some implementations have characteristics that should be taken into account in electrically coupling the microcomponents, which have not been an issue in the non-releasable microcomponents common in the prior art. For example, releasable microcomponents may move in relation to each other (e.g., translate and/or rotate in relation to each other), and an electrical coupling should be utilized to allow for such desired movement. Additionally, releasable microcomponents may be implemented in a manner such that the components are coupled out-of-plane with respect to each other, whereas non-releasable microcomponents of the prior art are generally only coupled in-plane (e.g., in the plane of the wafer of the microcomponents). Accordingly, electrical coupling mechanisms may be utilized to form an out-of-plane electrical coupling between two or more microcomponents. The electrical coupling mechanisms disclosed herein are suitable for use in various implementations of releasable microcomponents. For example, a ribbon cable, electrical connector, and/or a Z clamp connector may be utilized in electrically coupling such releasable microcomponents. For instance, the electrical coupling mechanisms disclosed herein may be implemented to allow for two or more microcomponents that move relative to one another to be electrically coupled. The electrical coupling mechanisms of the present invention may also be utilized to allow microcomponents to be electrically coupled in-plane or out-of-plane. For example, the electrical coupling mechanisms may be utilized to enable an electrical connection between microcomponents that are pulled off a wafer and coupled at 90 degrees to each other. Of course, while the electrical coupling mechanisms of the present invention are suitable for electrically coupling releasable microcomponents, the scope of the present invention is not intended to be limited solely to coupling releasable microcomponents. Rather, the electrical coupling mechanisms disclosed herein may be utilized in electrically coupling any type of microcomponents, including both released and non-released microcomponents.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An electrical connector for electrically coupling microcomponents, said electrical connector comprising:

at least one engagement member for coupling with at least a first microcomponent, wherein said electrical connector is capable of engaging said at least a first microcomponent in a manner that constrains three degrees of translational freedom of said at least a first microcomponent relative to said electrical connector without relying solely on frictional force in any of said three degrees;

at least one conducting material arranged to engage at least one conducting material of said at least a first microcomponent when said electrical connector is coupled with said at least a first microcomponent; and at least one latch mechanism for latching and removably blocking said at least one engagement member.

2. The electrical connector of claim 1 wherein said conducting material is gold.

3. The electrical connector of claim 1 wherein said electrical connector is capable of engaging said at least a first microcomponent in a manner that constrains rotational freedom of said at least a first microcomponent relative to said electrical connector.

4. The electrical connector of claim 1 wherein said at least one engagement member includes a barbed end.

5. The electrical connector of claim 4 wherein said barbed end includes a retaining surface for engaging the underside of a receptacle of said at least first microcomponent when said electrical connector is coupled with said at least a first microcomponent.

6. The electrical connector of claim 1 further comprising:

at least one constraining surface that is maintained flush against the upperside of said at least a first microcomponent when said electrical connector is coupled with said at least a first microcomponent.

7. The electrical connector of claim 1 wherein said at least one latch mechanism is for latching said at least one engagement member to a position for a desired presentation to a receptacle of said at least a first microcomponent.

8. The electrical connector of claim 7 wherein said position for a desired presentation is a position that enables said at least one engagement member to penetrate a receptacle of said at least a first microcomponent without contacting the edges of said receptacle.

9. The electrical connector of claim 7 wherein said position for a desired presentation is a position that enables said at least one engagement member to penetrate a receptacle of said at least a first microcomponent with a minimal insertion force applied.

10. The electrical connector of claim 1 further comprising:

at least one release mechanism for releasing said at least one engagement member to enable said at least one engagement member to couple said electrical connector with said at least a first microcomponent.

11. The electrical connector of claim 10 wherein said at least one release mechanism is arranged to release said at least one engagement member after said at least one engagement member has penetrated a receptacle of said at least a first microcomponent.

12. The electrical connector of claim 11 wherein upon said release mechanism releasing said at least one engagement member, said at least one engagement member applies a force against said receptacle.

13. The electrical connector of claim 1 having a ribbon cable coupled thereto.

14. An electrical connector for coupling at least two microcomponents, comprising:

a plurality of conducting materials that are electrically isolated from each other;

at least one engagement member for engaging a receptacle of at least a first microcomponent in a manner such that each of said plurality of conducting materials engages at least one conducting material of said at least a first microcomponent and in a manner that constrains three degrees of translational freedom of said at least a first microcomponent relative to said electrical connector without relying solely on frictional force in any of said three degrees; and at least one latch mechanism for latching and removably blocking said at least one engagement member.

15. The electrical connector of claim 14 wherein each of said plurality of conducting materials is gold.

16. The electrical connector of claim 14 wherein said electrical connector is capable of engaging said at least a first microcomponent in a manner that further constrains rotational freedom of said at least a first microcomponent relative to said electrical connector.

17. The electrical connector of claim 14 wherein said at least one engagement member includes a barbed end.

18. The electrical connector of claim 17 wherein said barbed end includes a retaining surface for engaging the underside of said receptacle when said electrical connector is coupled with said at least a first microcomponent.

19. The electrical connector of claim 14 further comprising: at least one constraining surface that is maintained flush against the upperside of said at least a first microcomponent when said electrical connector is coupled with said at least a first microcomponent.

20. The electrical connector of claim 14 having a ribbon cable coupled thereto.

21. The electrical connector of claim 14 wherein said at least one latch mechanism is for latching said at least one engagement member to a position for a desired presentation to said receptacle of said at least a first microcomponent.

22. The electrical connector of claim 21 wherein said position for a desired presentation is a position that enables said at least one engagement member to penetrate said receptacle of said at least a first microcomponent without contacting the edges of said receptacle.

23. The electrical connector of claim 21 wherein said position for a desired presentation is a position that enables said at least one engagement member to penetrate said receptacle of said at least a first microcomponent with a minimal insertion force applied.

24. The electrical connector of claim 14 further comprising:

at least one release mechanism for releasing said at least one engagement member to enable said at least one engagement member to couple said electrical connector with said at least a first microcomponent.

25. A method for electrically coupling a microcomponent with an electrical connector, said method comprising:

latching and removably blocking at least one engagement member of an electrical connector to a latched position;

engaging a receptacle of at least one microcomponent with said at least one engagement member of said electrical connector; and releasing said at least one engagement member from said latched position, wherein said electrical connector engages said at least one microcomponent in a manner that constrains three degrees of translational freedom of said at least one microcomponent relative to said electrical connector without relying solely on frictional force in any of said three degrees and in a manner such that at least one conducting material of said electrical connector engages at least one conducting material of said at least one microcomponent forming an electrical connection therebetween.

26. The method of claim 25 wherein said at least one conducting material is gold.

27. The method of claim 84wherein said electrical connector engages said at least one microcomponent in a manner that constrains rotational freedom of said at least one microcomponent relative to said electrical connector.

28. The method of claim 25 wherein said at least one engagement member includes a barbed end.

29. The method of claim 28 wherein said barbed end includes a retaining surface for engaging the underside of said receptacle of said at one microcomponent.

30. The method of claim 25 wherein said electrical connector engages said at least one microcomponent in a manner that maintains a surface of said electrical connector flush against the upperside of said at least one microcomponent.

31. The method of claim 25 wherein said latched position is a position for a desired presentation of said at least one engagement member to said receptacle of said at least one microcomponent.

32. The method of claim 31 wherein said position for a desired presentation is a position that enables said at least one engagement member to penetrate said receptacle without contacting the edges of said receptacle.

33. The method of claim 31 wherein said position for a desired presentation is a position that enables said at least one engagement member to penetrate said receptacle with a minimal insertion force applied.

34. A method for electrically coupling a microcomponent with an electrical connector, said method comprising:

latching and removably blocking at least one engagement member of an electrical connector to a latched position; and coupling said electrical connector to said at least one microcomponent such that a plurality of electrically isolated conducting materials of said electrical connector each engage at least one conducting material of said at least one microcomponent, wherein said electrical connector engages said at least one microcomponent in a manner that constrains three degrees of translational freedom of said at least one microcomponent relative to said electrical connector without relying solely on frictional force in any of said three degrees.

35. The method of claim 34 wherein each of said plurality of electrically isolated conducting materials is gold.

36. The method of claim 34 wherein said electrical connector engages said at least one microcomponent in a manner that constrains rotational freedom of said at least one microcomponent relative to said electrical connector.

37. The method of claim 34 wherein said coupling further comprises:

engaging a receptacle of said at least one microcomponent with said at least one engagement member of said electrical connector; and releasing said at least one engagement member from said latched position.

38. The method of claim 34 herein said latched position is a position for a desired presentation of said at least one engagement member to said receptacle of said at least one microcomponent.

39. The method of claim 38 wherein said position for a desired presentation is a position that enables said at least one engagement member to penetrate said receptacle without contacting the edges of said receptacle.

40. The method of claim 38 wherein said position for a desired presentation is a position that enables said at least one engagement member to penetrate said receptacle with a minimal insertion force applied.

41. A method for electrically coupling a microcomponent with an electrical connector, said method comprising:

latching and removably blocking at least one engagement member of an electrical connector to a latched position;

engaging a receptacle of at least one microcomponent with said at least one engagement member of said electrical connector; and releasing said at least one engagement member from said latched position, wherein said electrical connector engages said at least one microcomponent in a manner that constrains three degrees of translational freedom of said at least one microcomponent relative to said electrical connector without relying solely on frictional force in any of said three degrees and in a manner such that a plurality of electrically isolated conducting materials of said electrical connector each engage at least one conducting material of said at least one microcomponent.

42. The method of claim 41 wherein each of said plurality of electrically isolated conducting materials is gold.

43. The method of claim 41 wherein said electrical connector engages said at least one microcomponent in a manner that constrains rotational freedom of said at least one microcomponent relative to said electrical connector.

44. The method of claim 41 wherein said latched position is a position for a desired presentation of said at least one engagement member to said receptacle of said at least one microcomponent.

45. The method of claim 44 wherein said position for a desired presentation is a position that enables said at least one engagement member to penetrate said receptacle without contacting the edges of said receptacle.

46. The method of claim 44 wherein said position for a desired presentation is a position that enables said at least one engagement member to penetrate said receptacle with a minimal insertion force applied.

47. An electrical connector for electrically coupling microcomponents, said electrical connector comprising:

at least one engagement member for coupling with at least a first microcomponent, at least one conducting material arranged to engage at least one conducting material of said at least a first microcomponent when said electrical connector is coupled with said at least a first microcomponent; and at least one latch mechanism for latching and removably blocking said at least one engagement member to a latched position, wherein said at least one latch mechanism is not reliant on a coupling to a substrate for latching said at least one engagement member to said latched position.

48. The electrical connector of claim 47 wherein said electrical connector is capable of engaging said at least a first microcomponent in a manner that constrains three degrees of translational freedom of said at least a first microcomponent relative to said electrical connector without relying solely on frictional force in any of said three degrees.

49. The electrical connector of claim 47 wherein said electrical connector is capable of engaging said at least a first microcomponent in a manner that constrains rotational freedom of said at least a first microcomponent relative to said electrical connector.

50. The electrical connector of claim 47 wherein said latched position to which said at least one latch mechanism latches said at least one j engagement member is a position for a desired presentation to a receptacle of said at least a first microcomponent.

51. The electrical connector of claim 50 wherein said position for a desired presentation is a position that enables said at least one engagement member to penetrate said receptacle of said at least a first microcomponent without contacting the edges of said receptacle.

52. The electrical connector of claim 50 wherein said position for a desired presentation is a position that enables said at least one engagement member to penetrate said receptacle of said at least a first microcomponent with a minimal insertion force applied.

53. The electrical connector of claim 47 further comprising:

at least one release mechanism for releasing said at least one engagement member to enable said at least one engagement member to couple said electrical connector with said at least a first microcomponent.

54. The electrical connector of claim 53 wherein said at lease mechanism is arranged to release said at least one engagement member after said at least one engagement member has penetrated a receptacle of said at least a first microcomponent.

55. The electrical connector of claim 53 wherein said at least on release mechanism is not reliant on a coupling to a substrate for releasing said at least on engagement member.

* * * * *